US009814929B2

(12) United States Patent
Moser

(10) Patent No.: US 9,814,929 B2
(45) Date of Patent: Nov. 14, 2017

(54) TREADMILL

(71) Applicant: George Moser, Santa Clara, CA (US)

(72) Inventor: George Moser, Santa Clara, CA (US)

( * ) Notice: Subject to any disclaimer, the term of this patent is extended or adjusted under 35 U.S.C. 154(b) by 80 days.

(21) Appl. No.: 14/720,740

(22) Filed: May 23, 2015

(65) Prior Publication Data

US 2016/0287930 A1 Oct. 6, 2016

Related U.S. Application Data

(60) Provisional application No. 62/178,203, filed on Apr. 2, 2015.

(51) Int. Cl.

| | |
|---|---|
| ***A63B 22/04*** | (2006.01) |
| ***A63B 22/02*** | (2006.01) |
| ***A63B 71/06*** | (2006.01) |
| ***A63B 22/00*** | (2006.01) |
| ***A63B 24/00*** | (2006.01) |
| *A63B 21/005* | (2006.01) |
| *A63B 21/008* | (2006.01) |

(Continued)

(52) U.S. Cl.

CPC ..... *A63B 22/02* (2013.01); *A63B 22/0023* (2013.01); *A63B 22/0207* (2015.10); *A63B 24/0087* (2013.01); *A63B 71/0622* (2013.01); *A63B 21/0058* (2013.01); *A63B 21/0083* (2013.01); *A63B 21/0087* (2013.01); *A63B 21/0088* (2013.01); *A63B 22/0221* (2015.10); *A63B 22/0228* (2015.10); *A63B 22/0235* (2013.01); *A63B 2024/0093* (2013.01); *A63B 2071/0063* (2013.01); *A63B 2071/065* (2013.01); *A63B 2071/0683* (2013.01); *A63B 2220/18* (2013.01); *A63B 2220/30* (2013.01); *A63B 2220/56* (2013.01); *A63B 2220/833* (2013.01); *A63B 2225/20* (2013.01); *A63B 2225/50* (2013.01); *A63B 2230/01* (2013.01); *G06Q 50/22* (2013.01)

(58) Field of Classification Search

USPC ..... 482/54

See application file for complete search history.

(56) References Cited

U.S. PATENT DOCUMENTS 4,938,473 A * 7/1990 Lee ..... A63B 22/02 482/27

4,974,831 A * 12/1990 Dunham ..... A63B 22/0023 482/54

(Continued)

*Primary Examiner* — Stephen R Crow

(74) *Attorney, Agent, or Firm* — Brad Bertoglio

(57) ABSTRACT

A computerized treadmill is provided. The treadmill deck may be fully suspended by a plurality of air suspension elements, such as bellows. The bellows may be pressurized by a computer-controlled compressor feeding a central air reservoir to which each bellows is connected via air hose. The bellows may be dampened to control expansion. A double hinge connecting the deck with frame may control lateral movement and reduce lateral load on the bellows. Incline and decline mechanisms facilitate a variety of deck angles. Control of the treadmill may be by computer, whether integrated or modular, whether traditional, laptop, tablet or smart phone. Control of the treadmill and conveyance of information associated with treadmill operation may be integrated with computer or smart phone applications, whether dedicated or third party.

20 Claims, 29 Drawing Sheets

(51) Int. Cl.
*G06Q 50/22* (2012.01)
*A63B 71/00* (2006.01)

(56) References Cited

U.S. PATENT DOCUMENTS 4,984,810 A * 1/1991 Stearns ..... A63B 22/0221 482/54
5,149,084 A * 9/1992 Dalebout ..... A63B 24/0062 273/440
5,184,988 A * 2/1993 Dunham ..... A63B 22/0023 482/51
5,279,528 A * 1/1994 Dalebout ..... A63B 22/0023 482/54
5,336,144 A * 8/1994 Rodden ..... A63B 22/02 482/51
5,441,468 A * 8/1995 Deckers ..... A63B 22/0214 198/841
5,478,295 A * 12/1995 Fracchia ..... A63B 24/00 482/3
5,626,539 A * 5/1997 Piaget ..... A63B 22/0056 482/52
5,645,513 A * 7/1997 Haydocy ..... A63B 71/0622 482/3
5,667,459 A * 9/1997 Su ..... A63F 13/816 482/1
5,827,155 A * 10/1998 Jensen ..... A63B 22/02 267/160
6,413,191 B1 * 7/2002 Harris ..... G07F 17/32 273/138.1
6,953,418 B1 * 10/2005 Chen ..... A63B 22/0214 452/54
7,563,205 B2 * 7/2009 Alling ..... A63B 22/0235 482/4
7,628,733 B2 * 12/2009 Donner ..... A63B 22/02 482/54
8,308,592 B2 * 11/2012 Radding ..... A63B 22/02 264/41
8,435,160 B1 * 5/2013 Clum ..... A63B 22/02 482/54
8,968,163 B1 * 3/2015 Vidmar ..... A61H 3/008 482/43
2003/0073545 A1 * 4/2003 Liu ..... A63B 22/0235 482/54
2003/0153434 A1 * 8/2003 Dalebout ..... A63B 22/02 482/54
2004/0242378 A1 * 12/2004 Pan ..... A63B 22/0207 482/54
2006/0287163 A1 * 12/2006 Wang ..... A63B 22/0235 482/54
2007/0225127 A1 * 9/2007 Pan ..... A63B 22/02 482/54
2009/0036272 A1 * 2/2009 Yoo ..... A63B 22/0257 482/7
2009/0181829 A1 * 7/2009 Wu ..... A63B 22/02 482/54
2012/0178590 A1 * 7/2012 Lu ..... A63B 22/0235 482/54

* cited by examiner

SECTION A-A

TREADMILL

FIELD OF THE INVENTION

The present invention relates in general to the exercise equipment field, and in particular, to treadmills having improvements in one or more areas such as deck support, deck positioning, console positioning and electronic controls.

BACKGROUND OF THE INVENTION

Modern society has created a lifestyle for many members of society that can be characterized as sedentary, with many hours of minimal or no physical activity, typically sitting at a desk or computer. Simultaneously, the diet of many people has deteriorated, with ensuing obesity, diabetes, heart disease and many other modern diseases. This lifestyle has also led to high growth in the cost of health care for society.

Many of the above issues can be addressed through exercise. The treadmill is one of the most popular exercise machines available, and could play a major role in addressing issues of health and fitness. The treadmill typically provides a continuous rotating surface on which individuals can run or walk in place. In some cases, the surface is formed from an elastic belt driven by rollers and supported by an underlying rigid deck. In other cases, the surface may be formed from a series of rigid slats running perpendicular to the direction of rotation. In both scenarios, a drive motor propels the surface, typically at a variable speed. Often times, an incline motor is able to adjust the angle of the rotating treadmill running or walking surface to simulate uphill and/or downhill movement.

However the treadmill, which has been around for many decades, still has many unresolved shortcomings that discourage a wider use. Two major shortcomings of treadmills are:

a) Impact: potential damage to joints because of repetitive impact, which eventually causes fatigue failure to joints or bones. Fatigue is a well-known effect in engineering and well described by the Woehler curve, which causes failure of mechanical components due to stresses that can be well tolerated if they happen occasionally but will lead to failure if applied repetitively; an analogy would be bending a wire a couple of times, which probably will not cause damage to the wire, but if that is repeated back and forth many times, it is likely that the wire will break. The legs can be subjected to hundreds of thousands of repetitive impacts on a conventional treadmill, so fatigue is a very real issue in these machines; and b) boredom during usage of the treadmill, which leads to users giving up and not coming back to the treadmill, which often becomes a dust collector in a household.

Embodiments of the present invention may address those and/or other issues. Some embodiments provide a technological solution that reduces repetitive impact injury to users and at the same time keeps users motivated to continue the regular usage of the treadmill. Embodiments also integrate the diet and other types of exercise into the treadmill usage program to create a comprehensive lifestyle management system that revolves around the treadmill.

There have been many unsuccessful attempts to resolve the above issues, which continue to plague even the latest, most advanced treadmills. One early attempt is shown in U.S. Pat. No. 4,974,831, which discloses a treadmill with a complex system of dampeners and lever arms located under the deck of the treadmill, intended to reduce the intensity of the impacts on the user. The proposed structure has issues of excessive complexity and high cost, as well as non-adjustability, meaning that all users are treated equally, despite differences in size, weight, age, gender, health condition, prior injuries, and the like.

Another attempt in the prior art is shown in U.S. Pat. No. 4,984,810, which discloses a treadmill pivoted at its rear end and resting on a spring/shock absorber combination located at the forward end of the treadmill. This arrangement provides very limited and partial dampening at best, because the rear of the treadmill is sitting undampened on a rigid steel bar. In addition, this system is also non-adjustable and non-controllable.

A further attempt is shown in U.S. Pat. No. 5,827,155, which discloses a dampening system based on a longitudinally extending leaf spring (similar to some truck suspensions). This system tries to provide some adjustability through possible longitudinal movement of an adjustment metal bar along the treadmill. However, the complexity, cost and weight of such a system make it impractical. In addition, a user would have to stop the treadmill and climb underneath to do any adjustments, and repeat this trial and error procedure until the right point is reached, which is not something most users would be willing to do.

U.S. Pat. No. 5,279,528 shows a treadmill equipped with air-filled rubber bladders which are laid between the side rails of the treadmill and its deck. Therefore the rubber surface of the bladders is in direct contact, "sandwiched" between the metal rail on one side and the wooden deck on the other side. This arrangement is susceptible to wear, noise, potential cuts and punctures, air leaks, high cost and short useful life of the bladders. It is believed to be an impractical approach that has never reached wide scale commercial implementation, likely for the reasons just mentioned. That same patent mentions as an alternative the use of foam or rubber strips instead of the air bladders. That is a more practical approach that has been used for many years, but of course it lacks adjustability.

U.S. Pat. No. 8,435,160 ("the '160 patent") discloses a treadmill based on two main features: a) a set of wheels at the rear end of the treadmill, with said wheels sitting directly on the floor and providing a pivoting axis around which the whole upper structure of the treadmill can be rotated and raised, and b) a set of air springs at the front end of the treadmill intended to cushion the upper structure of the treadmill. This proposed structure has several disadvantages and shortcomings. A major disadvantage is that it dampens only the front of the treadmill, while the rear wheels sit undampened directly on the floor (which is rigid and generates impact reaction forces that may continue to hit the user). It is the equivalent of a car with dampeners only in the front; nobody would be happy inside such a car, not only the rear passengers who would get the full impact of any bumps but also the front passengers, because they would get a substantial portion of those impacts as well (the metal structure propagates the impacts to everybody). A second major issue with that proposed configuration is that the full weight of the treadmill upper structure (including its heavy metal frame structure, deck, stepping board, belt and other components plus user weight) has to be carried by the air springs. That makes it necessary to use relatively stiff air springs with high internal air pressure, and the ability to dampen the user is severely limited (the air springs have to be designed to carry the machine weight plus the person, not just the person). The result is a relatively stiff ride with significant user impact.

A further problem in the '160 patent is the unnatural pivoting motion of the user when potentially using such a machine. Instead of experiencing the normal, primarily vertical "ups and downs" of a walk, the user would be subject to a repetitive circular motion around the contact point of the rear wheel on the floor, which may feel unnatural and potentially uncomfortable or dizzying.

Another issue in '160 patent is the absence of a complete dampening system. In some ways, the air springs are analogous to rubber balls at relatively high pressure, potentially behaving in a "springy" and "bouncy" manner. The undampened air springs can lead to an uncomfortable ride on the treadmill.

U.S. Pat. No. 8,308,592 describes another approach to reduce impact, based on a foamed cushion layer. Similar foam or polymer layer approaches have been used for many years, but they provide limited cushioning and very limited or no adjustability to different users.

U.S. Pat. No. 8,968,163 addresses the issue of impact and weight by providing a set of supports including a saddle to enable a user to exercise with minimal weight or impact on the body. This is intended primarily for therapy purposes.

Another major problem with treadmills is their boring nature which makes many users abandon their exercise program. There have been attempts to address that by connecting video players, TV monitors or computers to the treadmill, in order to be able to provide entertainment and games. U.S. Pat. No. 5,478,295 describes an interface to a computer that constantly displays a speed target to keep the user motivated. U.S. Pat. No. 5,149,084 describes a motivational display. U.S. Pat. No. 6,413,191 combines the treadmill with a game of chance to maintain motivation and interest. U.S. Pat. No. 5,667,459 describes a game to help keep the treadmill user interested. U.S. Pat. No. 5,645,513 describes an exercise apparatus that can interact with an external video game console such as a Nintendo machine and/or a TV display. Despite all those ideas and concepts, the problem of boredom remains largely unsolved and many users quit the use of the treadmill after a short period of time due to boredom.

Some embodiments of the present invention addresses some or all of the health and the boredom issues in treadmills in a novel way that can revolutionize the use of this type of exercise equipment with huge benefits for individuals and society.

SUMMARY

The present disclosure describes treadmills having improved systems for deck suspension, orientation adjustability and electronic control. In accordance with one aspect, a treadmill includes a rigid treadmill frame, the frame supporting a front roller and rear roller. A flexible belt wraps around the front roller and rear roller. A rigid planar treadmill deck is interposed between the front and rear rollers, beneath the top portion of the belt. The deck is fully suspended relative to the frame by a plurality of air suspension elements. A double hinge may be provided to movably connect the deck with the frame. In some embodiments, one or more of the air suspension elements is formed from an upper fitting, which is secured to the deck, and a lower fitting, which is secured to the frame. A membrane encloses a volume of air between the upper and lower fittings. In some embodiments, the upper and lower fitting are formed from metal, and the membrane is an elastic membrane.

In some embodiments, the air suspension elements include a dampening mechanism. For example, the upper and lower fittings may be interconnected by a dampening strap to limit movement of the upper and lower fittings away from one another during unloading of the air suspension element. Such a dampening strap may be, e.g., a fabric strap or an elastic strap. In other embodiments, a dampening mechanism may include a damping piston attached to one of the upper or lower fittings, and a receptacle attached to the other fitting, with the piston configured for movement within the receptacle during loading and unloading of the air suspension element. In some embodiments, the receptacle may be fluid-filled; the piston may include a first orifice enabling bi-direction fluid flow between a first side of the piston and a second side of the piston, with a check valve enabling unidirectional fluid flow from the first side of the piston to the second side of the piston.

A system for maintaining a desired level of pressure within the air suspension elements may be provided. In some embodiments, the treadmill includes an air reservoir. The air reservoir may be interconnected with one or more of the air suspension elements by air lines. An electronically-controlled compressor may be operable to control air pressure within the reservoir. In some embodiments, an air pressure sensor may be included to provide output indicative of the measured air pressure within one or more locations such as the air reservoir or one or more air suspension elements. A control input may be provided to the air compressor to control its actuation, thereby contributing to the control of air pressure within the air reservoir. Compressor control inputs may be determined based on one or more factors. In some embodiments, such factors may include one or more of belt speed, user impact level, and a user-controlled configuration setting.

In some embodiments, treadmill components such as the belt drive motor, incline motor, and compressor, may be positioned within an area defined by the flexible belt.

Deckless treadmills may also be implemented. In some such embodiments, a plurality of adjacent slats extend across a treadmill running surface perpendicularly to the direction of travel. The slats are movably mounted on a slat guide. One or more air suspension elements interconnect the slat guide with a rigid frame. The slat guide may be fully suspended by the air suspension elements, relative to the rigid frame. Various air suspension elements designs may be utilized.

In accordance with another aspect, an incline mechanism may be provided. In some such embodiments, a treadmill may include a rigid frame with left and right rails. Incline mechanism slots extend longitudinally within each of the left and right rails. An incline crossbar extends between the left and right rails, with ends extending through each of the incline mechanism slots. Left and right incline support bars each have proximal ends rotatably connected with the incline crossbar ends, and distal ends which may include wheels. Linkage bars have proximal ends rotatably connected with the rails at a position forward of the incline mechanism slots, and distal ends rotatably connected with the incline support bars. An incline motor can operate to rotate a lead screw, which is threaded through an incline mechanism control nut secured to the incline crossbar. Operation of the incline motor alternatively deploys and retracts the incline support bars to increase and decrease the angle of treadmill incline.

A treadmill decline mechanism may also be provided, to position the treadmill into declining angles. Decline mechanism slots may be provided within the left and right rails, with a decline crossbar extending between the rails through the decline mechanism slots. Decline support bars have proximal ends rotatably connected with the rails, and a middle portion rotatably connected with decline linkage bars. The decline linkage bars have opposite ends rotatably connected with the decline crossbar. A decline mechanism control nut is secured to the decline crossbar, with the incline motor lead screw threaded through it. In some embodiments, rotation of the lead screw can cause retraction of the incline support bars, followed by deployment of the decline support bars. In some embodiments, upright poles are connected with the treadmill frame, and move with it during inclination of the treadmill. An electronic display can be mounted on the upright poles.

In accordance with another aspect, a treadmill includes a continuous rotating surface and a drive motor controlling rotary motion of the rotating surface. An external digital interface, such as an electrical connector or wireless transceiver, is adapted for communication with an external computer. A control board received input via the external digital interface and provides an output control signal to the drive motor. The treadmill may include other systems, sensors and controls, such as electromechanical devices like an incline motor, fan and/or compressor, which receive control signals from the control board, which is in turn controlled by signals received from the external digital interface. In some embodiments, devices such as a mobile phone, tablet or computer may therefore be utilized to control the treadmill.

In accordance with another aspect, methods and systems for digital networking of exercise equipment are provided. In some embodiments, a method is provided for displaying digital media on a plurality of exercise machines. Digital media files are downloaded via the Internet onto a central digital storage device managed by an Internet-connected server. The server receives a request from one of the exercise machines for digital medial files. The requested digital media files are transferred from the central server to the requesting exercise machine, either via bulk download for storage on a local exercise machine storage device, or via streaming over a network.

Various other objects, features, aspects, and advantages of the present invention and embodiments will become more apparent from the following detailed description of preferred embodiments, along with the accompanying drawings in which like numerals represent like components.

DETAILED DESCRIPTION

Figure 1:
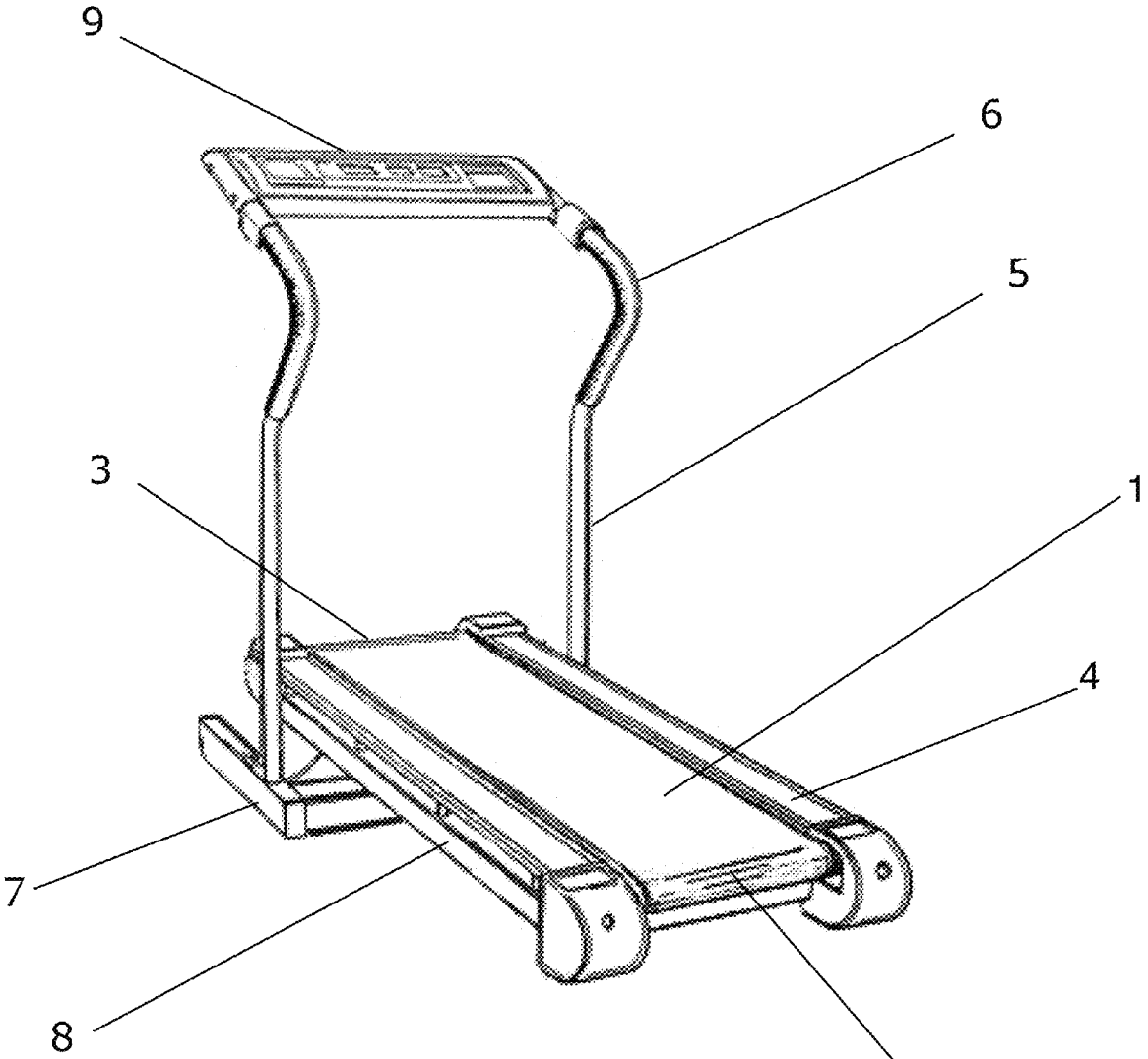
Fig. 1 (Prior Art)
FIG. 1 is a perspective view of a prior art treadmill.

While this invention is susceptible to embodiment in many different forms, there are shown in the drawings and will be described in detail herein several specific embodiments, with the understanding that the present disclosure is to be considered as an exemplification of the principles of the invention to enable any person skilled in the art to make and use the invention, and is not intended to limit the invention to the embodiments illustrated.

FIG. 1 shows a perspective view of a typical prior art treadmill. The belt 1 is a rubber belt that the user walks on. The belt wraps around rear roller 2 and front roller 3. On both sides of the treadmill there are stepping boards 4 that the user can use to rest on without walking. The stepping boards are mounted on the side rails 8, which are rigid metal beams that define a strong frame, to which various components are mounted, such as rollers 2 and 3. Upright poles 5 provide to the user through the handlebars 6, and also carry the console 9. Base 7 supports the upright poles 5.

Figure 2:
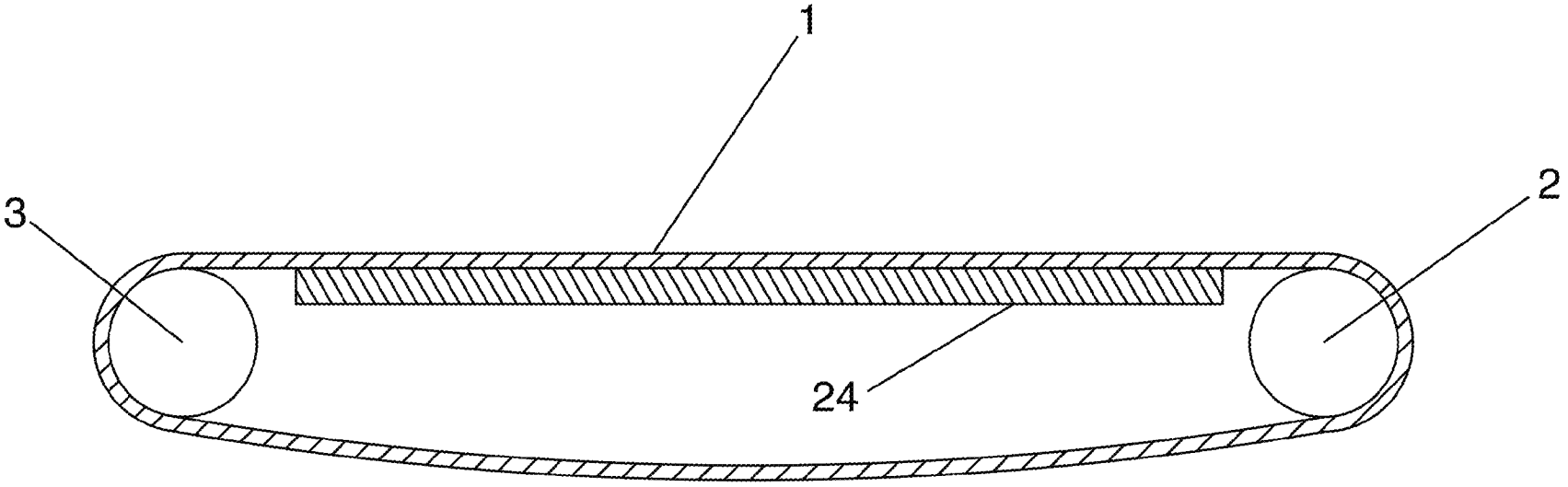
Fig. 2 (Prior Art)
FIG. 2 is an elevation of a prior art treadmill belt, rollers and deck.

FIG. 2 shows a longitudinal cross-section of the belt mechanism in the prior art treadmill of FIG. 1, with the front roller 3, the rear roller 2, the belt 1 and deck 24. The belt 1 is a relatively thin, flexible belt that would not be able to carry a person walking on it without additional support. The user's weight is carried by deck 24, which is typical a large, rigid, flat board located under the belt. Decks are commonly made of wood or MDF (medium density fiberboard). The surface of the board is treated to make it smooth and slippery so that the belt can easily slide on it. The deck is attached to side rails 8 of the treadmill.

The opportunity for repetitive stress injury using prior art treadmills can be perceived via a further look at FIG. 2. The user is ultimately walking or running on a heavy, rigid MDF plank 24, which in turns is sitting on rigid metal beams. That typically constitutes a very rigid, unforgiving walking or running surface. Some manufacturers insert rubber blocks between the MDF deck and the supporting metal beams, but that does little to reduce the severity of the repetitive impacts and the potential damage to the user's joints and bones.

Figure 3:
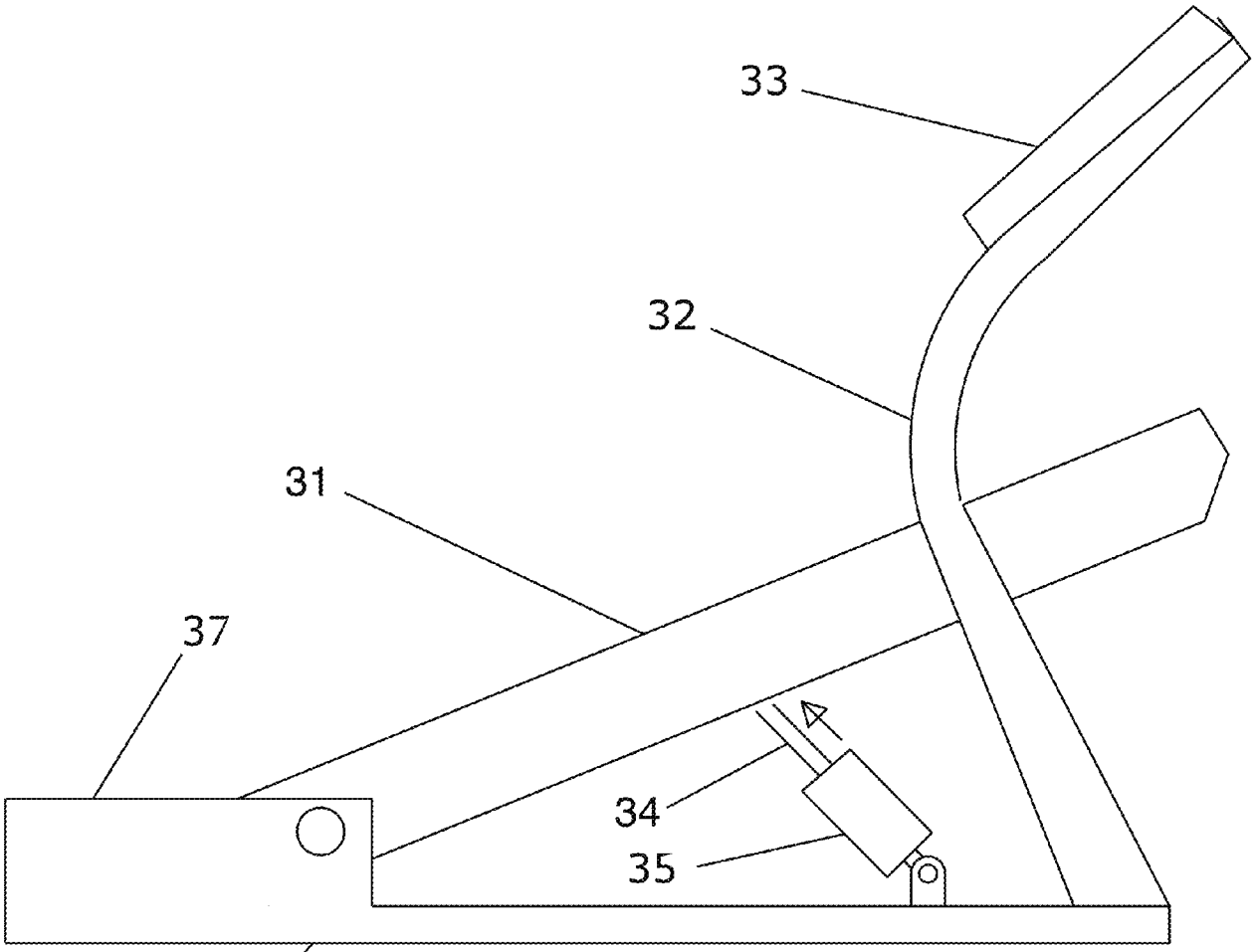
Fig. 3 (Prior Art)
FIG. 3 is a side elevation of another prior art treadmill embodiment.

FIG. 3 shows another important feature of many prior art treadmills: the ability to incline the deck and belt to increase exercise intensity by simulating uphill walking or running. Incline motor 35 is located under the upper structure 31 of the treadmill. The upper structure pivots around the base 36 of the treadmill. The upper structure includes the belt, the rollers, the MDF deck, the side rails and other components, described further below in connection with FIG. 4. Incline motor 35 is typically a linear motor with an actuator 34 that extends linearly when the motor is turned, lifting the front end of upper structure 31 relative to base 36. Console pole 32 carries the console 33. The base 36 extends rearward from the rear belt roller, creating a compartment 37 slightly behind the treadmill. The purpose of this compartment 37 is to contain an electric motor that propels the belt (not shown). Some treadmills have a slightly different configuration, with a motor hanging from the bottom of the upper structure 31.

Figures 4, 4A:
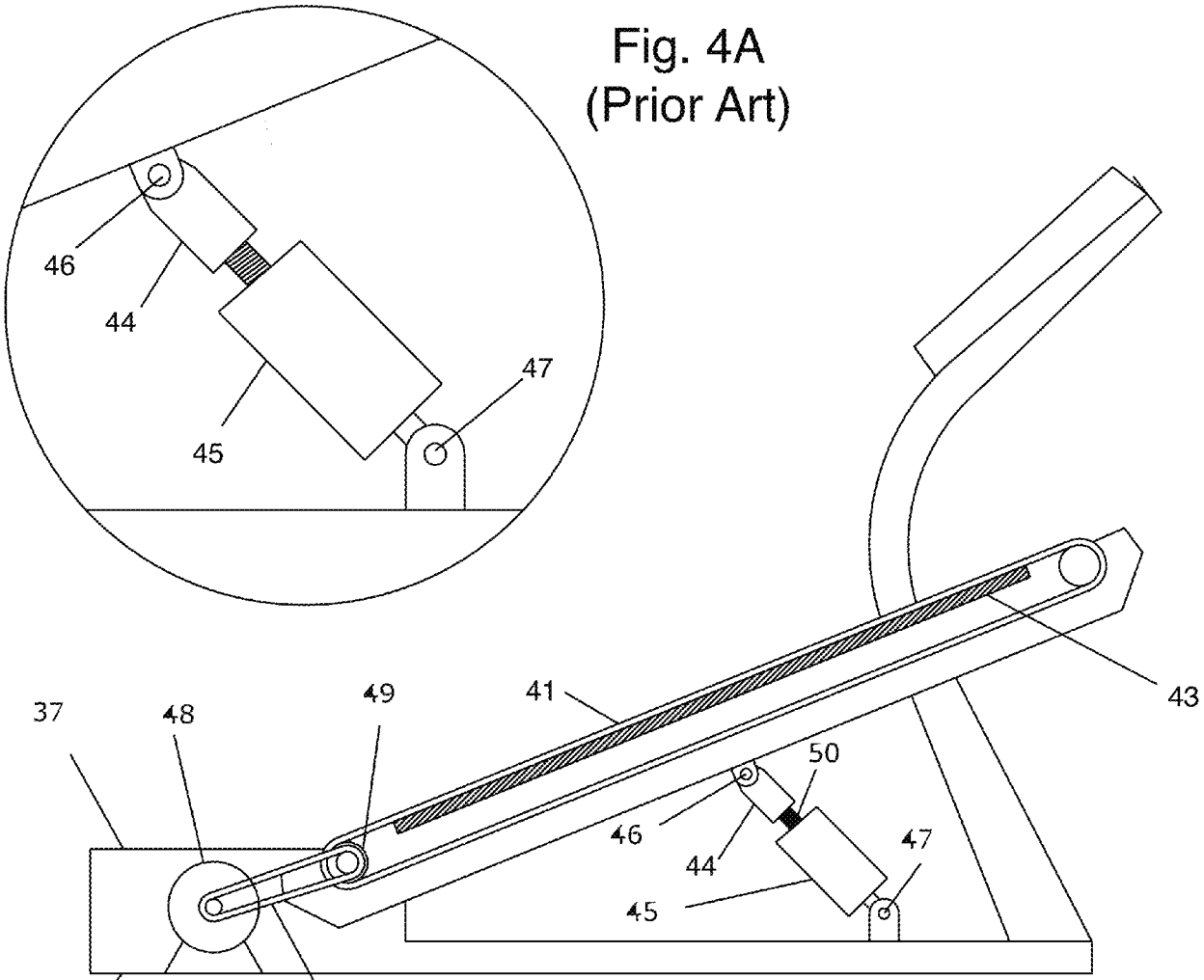
Fig. 4 (Prior Art)
Fig. 4A (Prior Art)
FIG. 4 is a side elevation of another prior art treadmill embodiment.
FIG. 4A is an exploded elevation of the incline mechanism of the treadmill of FIG. 4.

FIG. 4 shows a longitudinal cross-section of the prior art treadmill of FIG. 3, further clarifying the internal components of the treadmill. The electric belt motor 48 is located inside the compartment 37, and propels the rear roller 49 via a short transmission belt 42, thereby propelling the running belt 41 on top of MDF deck 43. The desired incline angle of the running surface 41 is determined by the incline motor 45, which is typically a linear motor with a lead screw 50 which engages with the mating nut 44. The nut is attached to a pivot point 46. The incline motor 45 is rotatably attached to a pivot point 47. The motor 45 causes the lead screw 50 to rotate. That rotation causes the nut 44 to unwind and move axially away from the motor. Thus the distance between pivot points 47 and 46 is increased, causing the rotable part of the treadmill structure with belt 41 to rotate upwards and increasing the incline angle to a steeper position.

FIG. 4A is an exploded view of the details of the incline motor mechanism for better clarity.

Figure 5:
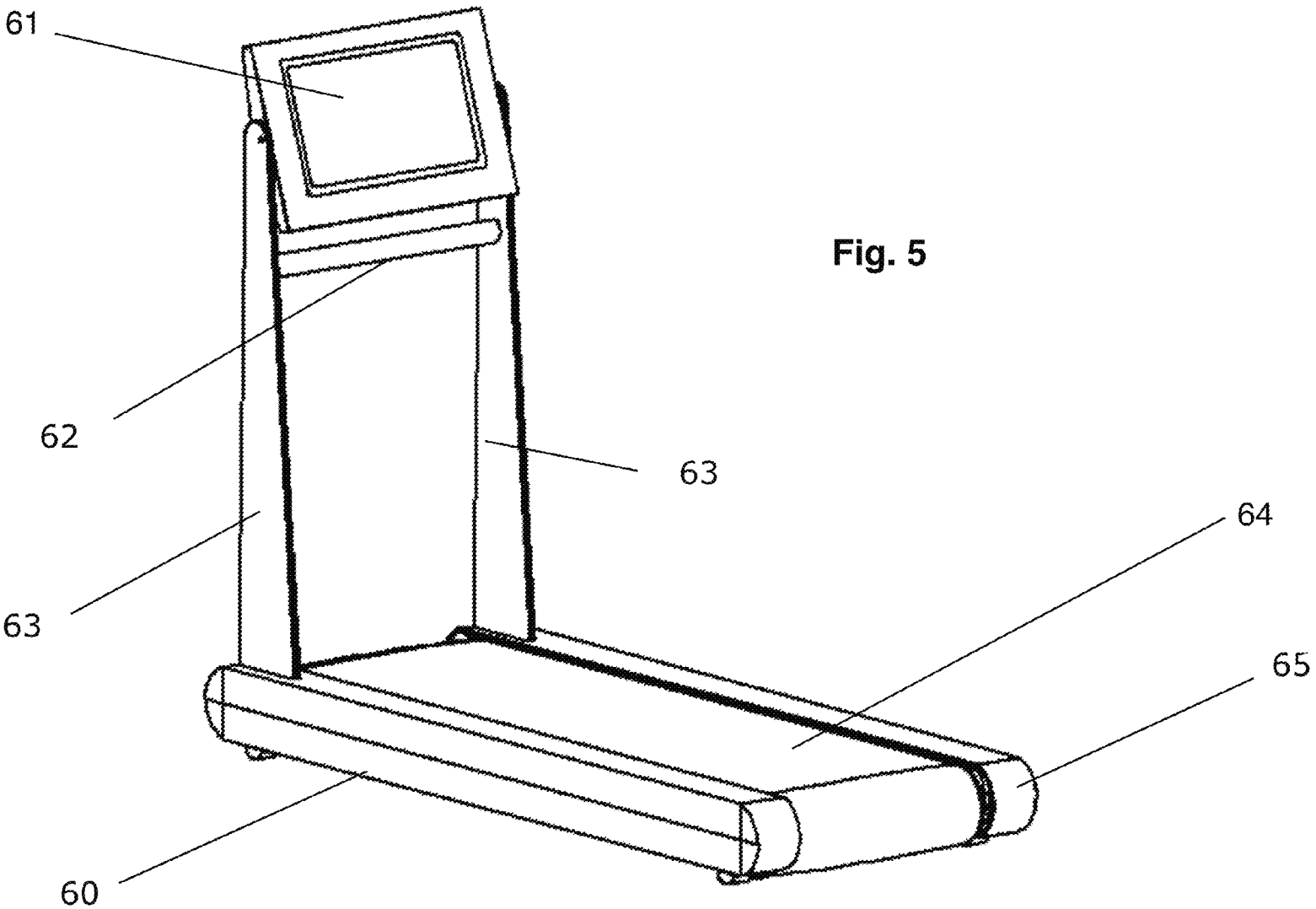
FIG. 5 is a perspective view of a treadmill, in accordance with one embodiment.

FIG. 5 is a perspective view of one embodiment of an improved treadmill. Instead of the traditional large console of prior art treadmills with numerous buttons and physical controls, the treadmill of FIG. 5 uses a touchscreen display for user interaction. The large number of buttons and controls that are typical of prior art treadmills is preferably absent; instead the computerized treadmill of FIG. 5 relies almost completely on the touchscreen to interface with the user. It is believed that most users of prior art treadmills do not use many of the buttons and controls, and instead use almost exclusively the speed buttons (up and down), because they don't have the patience or desire to try to understand and utilize a wide array of buttons and controls, many of which may be unintuitive. That aggravates the problem of boredom, because most users don't take advantage of exercise programs or entertainment programs, even to the extent they are made available by the treadmill. Embodiments of a treadmill touchscreen interface can introduce intuitive user interfaces and dynamic screens that create user engagement and entertainment, taking advantage of the fact that most users are already familiar with user interactions common on computer, tablet and smartphone interfaces, which are much easier than learning how to use proprietary arrangements of physical buttons and controls.

In the embodiment of FIG. 5, smart treadmill 60 includes touchscreen display 61. Handlebar 62 can provide support to the user as needed. Upright poles 63 support handlebar 62 and display 61. Belt 64 is propelled by large, oversized rollers housed under the covers 65.

Figure 6:
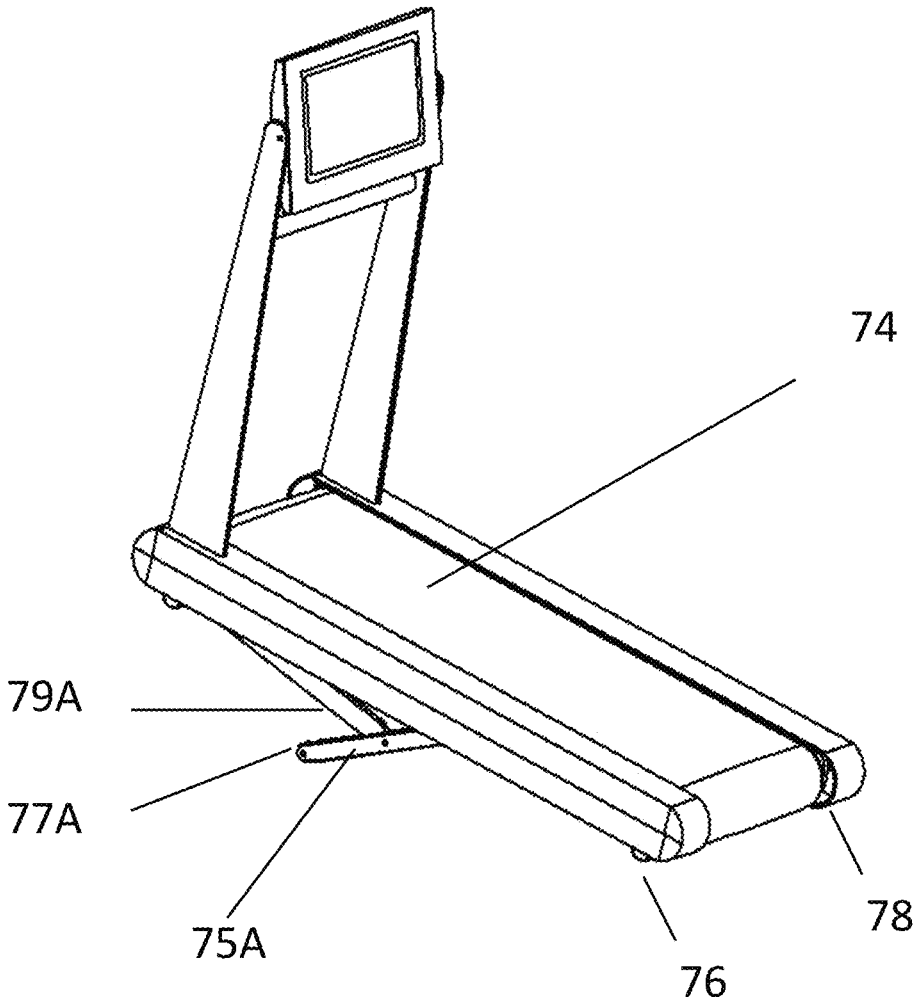
FIG. 6 is a perspective view of a treadmill in an inclined position.

FIG. 6 illustrates how treadmill 60 can be inclined to increase energy consumption by the user. A lifting linkage mechanism is provided, preferably including support bar mechanisms on both of the left and right sides of the bottom side of treadmill 60. Left side support bar 75A, which has a support bar wheel or roller 77A towards its distal end, at a point of contact with the floor, is deployed downwards by operation of an electric motor mechanism described further below. As a result, the front of the treadmill is lifted, pivoting about rear wheels 76 and 78, mounted on the underside of the treadmill frame towards the rear of treadmill 60. Support bar 75A is connected with linkage bar 79A as part of a lifting linkage mechanism which is explained in more detail in the following figures.

Figure 7:
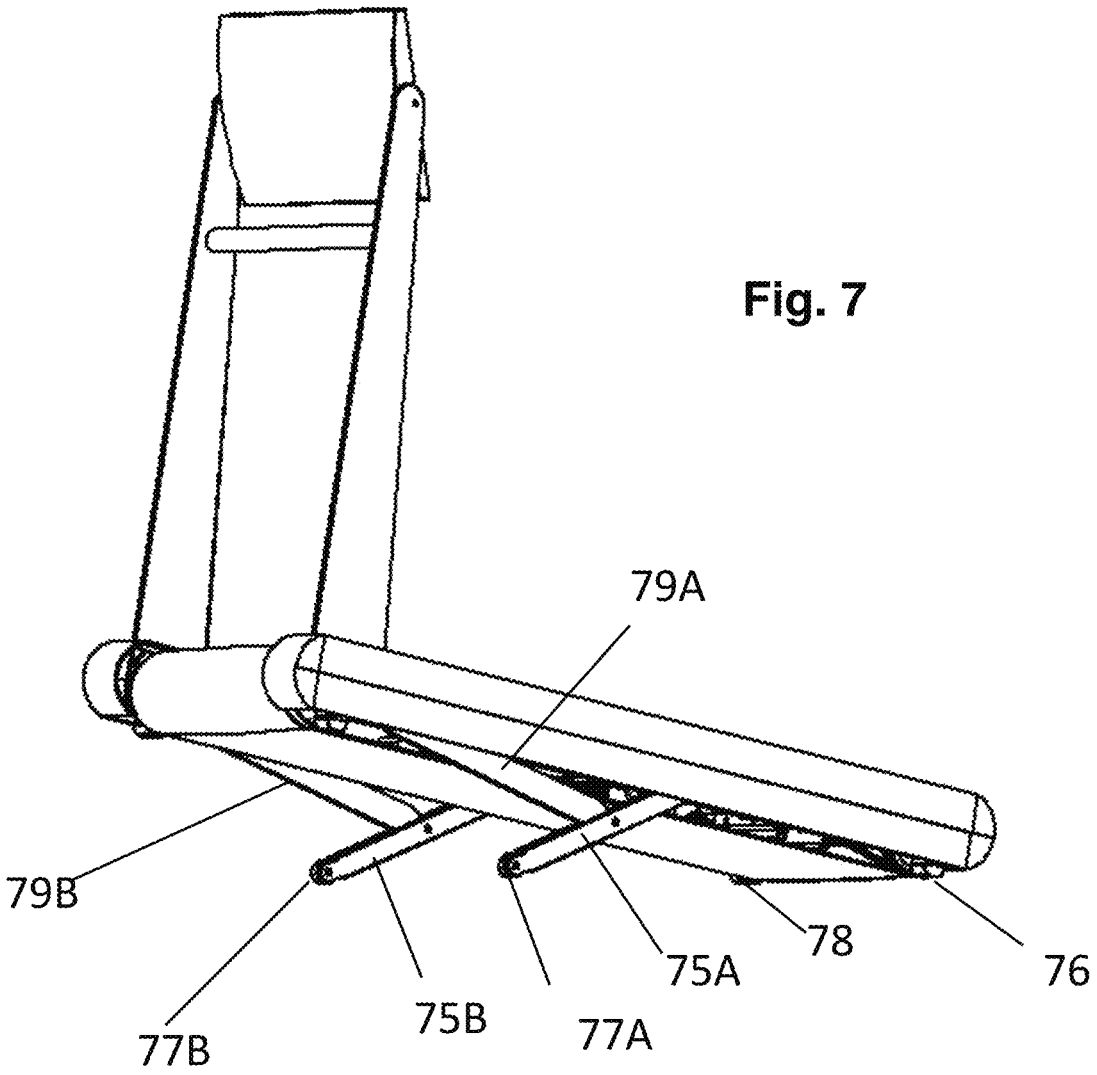
FIG. 7 is a lower perspective view of a treadmill in an inclined position.

FIG. 7 is a perspective view showing the underside of treadmill 60, to further clarify the lifting linkage mechanisms. A distal end of linkage bar 79A is attached to support bar 75A via a hinge mechanism positioned towards the middle of support bar 75A. The proximal end of linkage bar 79A is mounted to the treadmill frame via a fixed hinge, as illustrated further, e.g., below and in FIG. 11. The left side incline mechanism is substantially replicated on the right side of treadmill 60 by support bar 75B, wheel 77B and linkage bar 79B.

Figure 8:
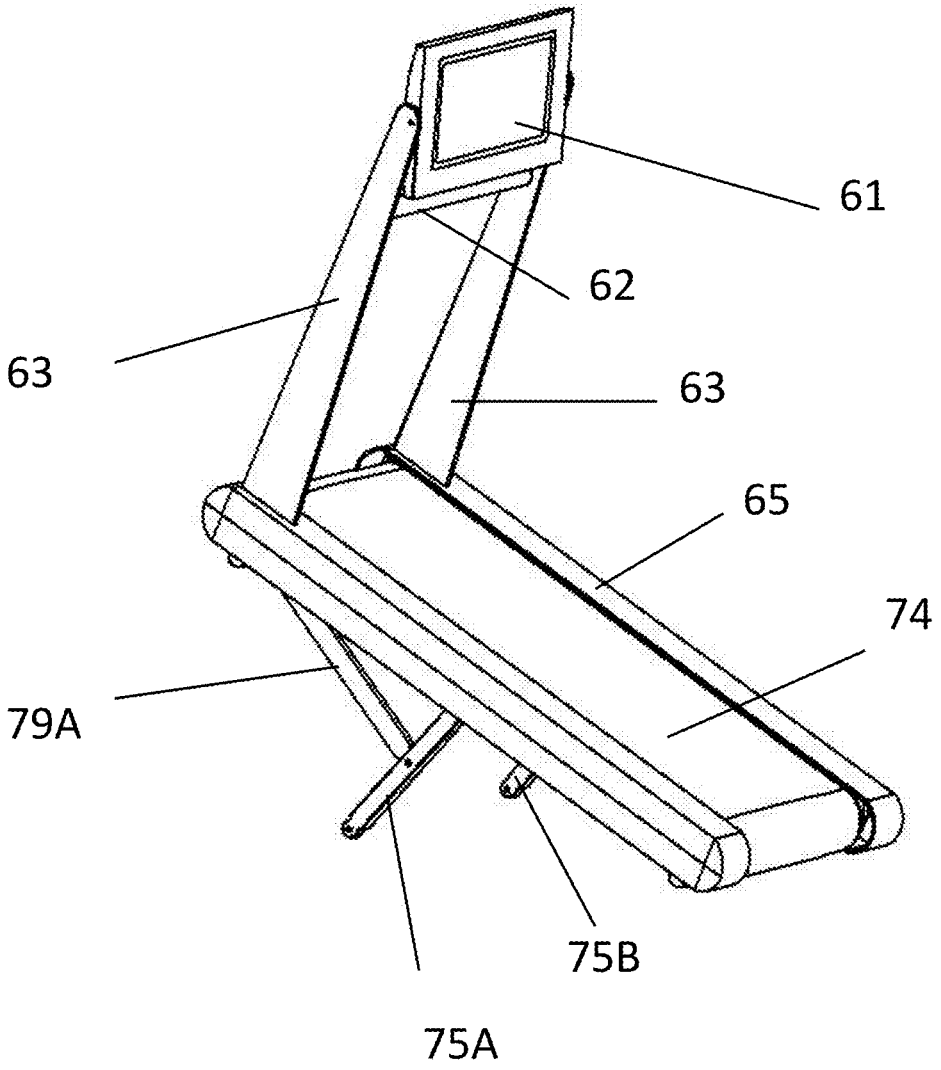
FIG. 8 is a side perspective view of a treadmill in an inclined position.

FIG. 8 illustrates treadmill 60 in a high degree of incline, which can be achieved through the special incline mechanism geometry described herein. Embodiments of the treadmill of FIG. 8 are believed to be able to achieve inclines of approximately 60%, which compares favorably with the maximum incline of 40% that certain prior art treadmills have been able to achieve. Another advantage of the special geometry of treadmill 60 is that when the treadmill is inclined, display 61 and handlebar 62 rise with the walking/running surface of belt 74, by virtue of being mounted on upright poles 63, which in turn are connected with a common frame with the belt rollers. By raising display 61 in conjunction with belt 74, a relatively consistent distance can be maintained between the user and display 61 at varying levels of incline. Such a configuration may be advantageous to users compared to prior art treadmills having a console and handlebar resting at fixed elevation relative to the floor, such that the distance from the user's upper body increases substantially when the treadmill is inclined, forcing the user to adopt an uncomfortable posture and hold on to special extended supports that protrude from the top of the console.

Figure 9:
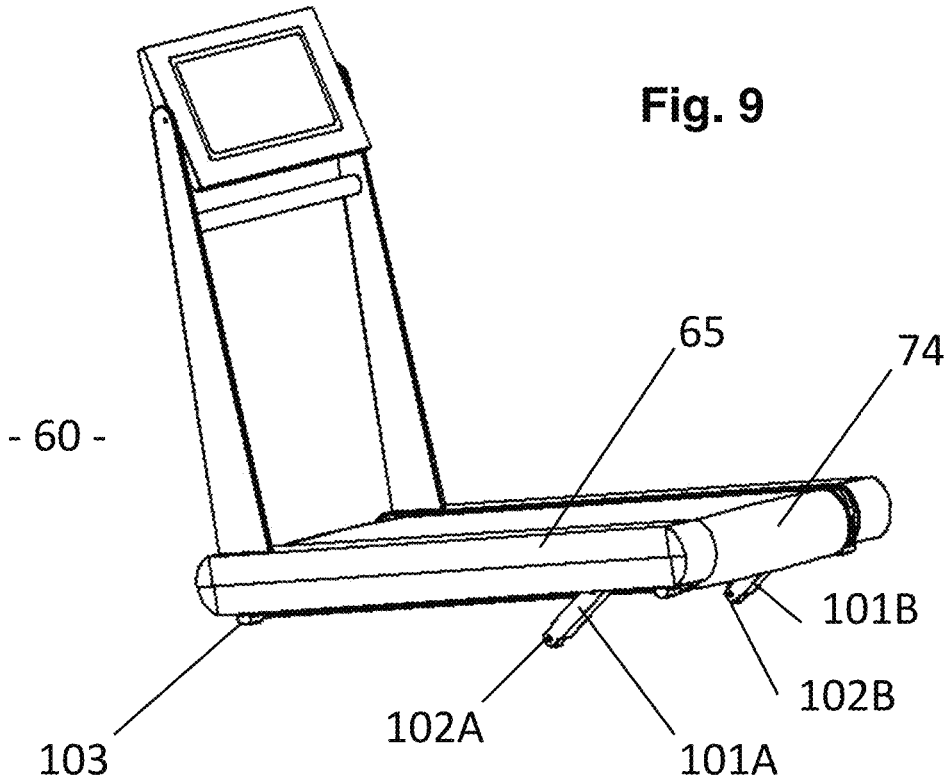
FIG. 9 is a perspective view of a treadmill in a declined position.

FIG. 9 illustrates how treadmill 60 can also be declined forward, simulating the user running or walking downhill. Decline support bars 101A and 101B are deployed through a channel in the lower side of covers 65, towards the rear of treadmill 60, by a linkage mechanism to raise the elevation of the rear of treadmill 60. A proximal end of each decline support bar 101A and 101B is pivotally mounted to an electric motor (described further below) positioned primarily within the loop of belt 74. A distal end of decline support bars 101A and 101B includes wheels 102A and 102B, respectively, oriented to roll against the ground on which treadmill 60 rests while decline support bars 101 rotate to adjust the level of treadmill declination. Rotation downward of support bars 101 acts to raise the rear of the treadmill, which pivots upwards about frontal feet 103. Frontal feet 103 are positioned on the front left and right bottom corners of treadmill 60, and rest on the ground when treadmill 60 is in a decline position as illustrated in FIG. 9.

Figure 10:
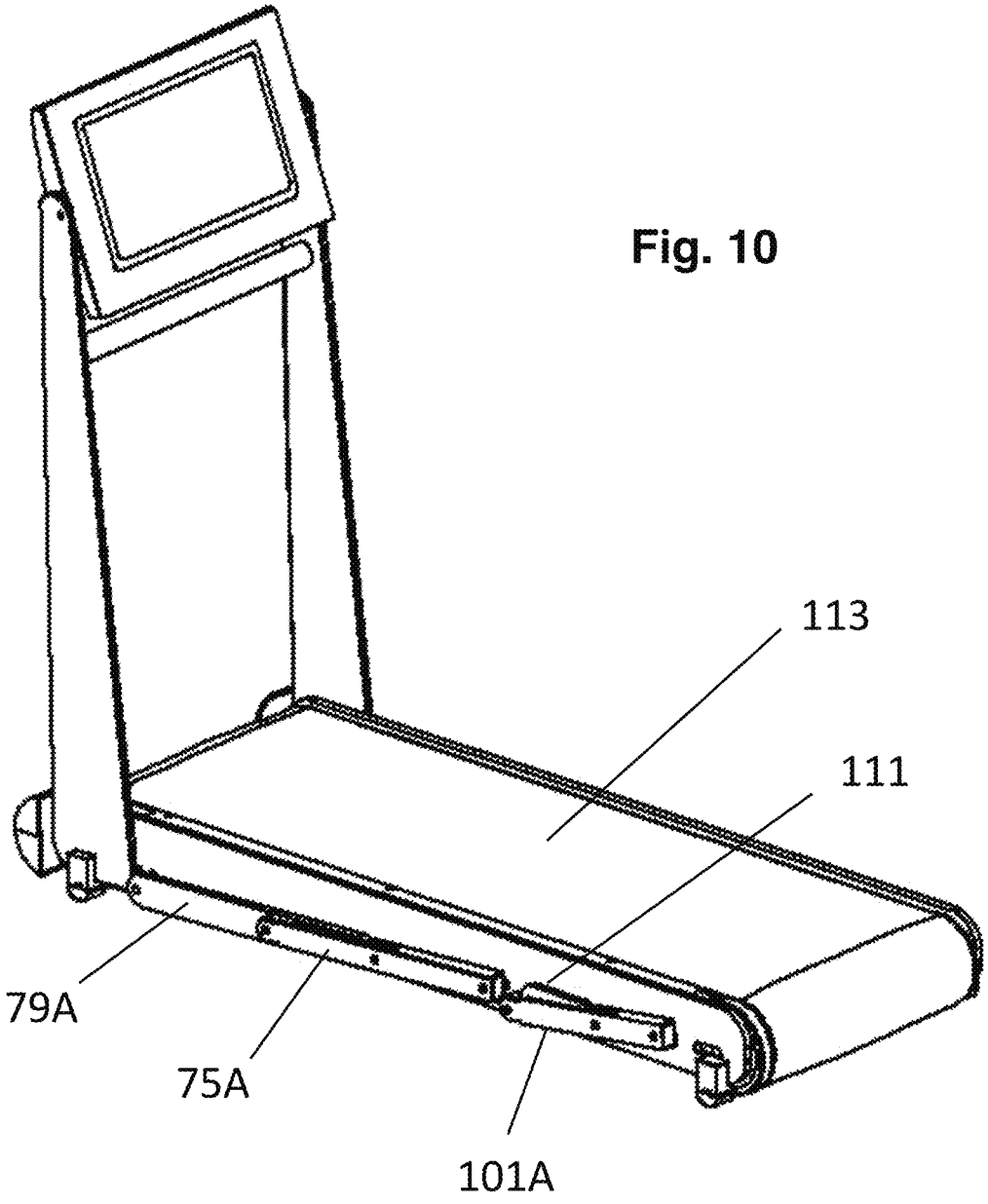
FIG. 10 is a perspective view of a treadmill with removed side covers.

FIG. 10 shows treadmill 60 in a level orientation, with covers 65 and underlying stepping boards removed. Support bar 75A and decline support bar 101A are mounted adjacent to the external surface of frame side rail 111.

Figure 11:
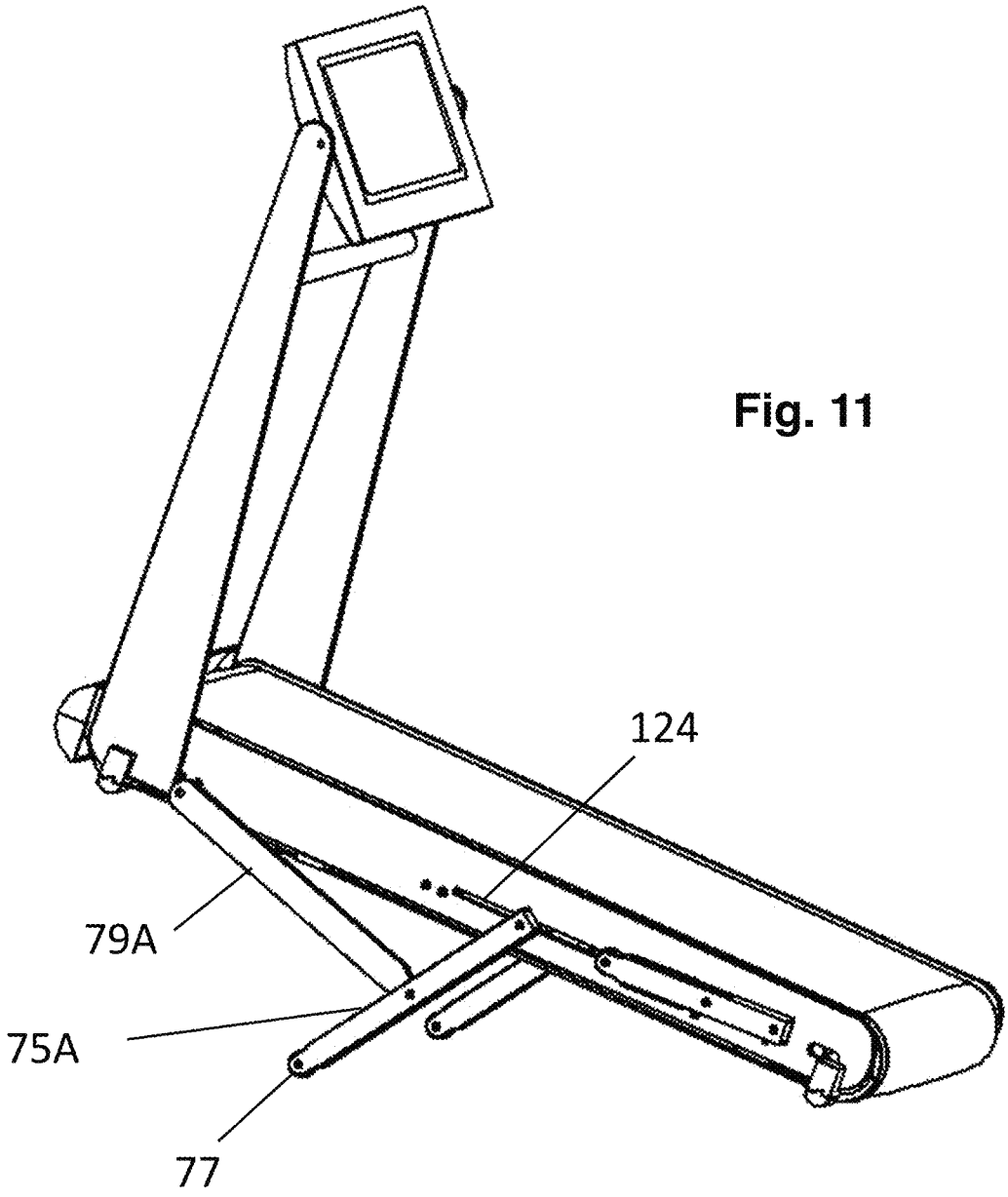
FIG. 11 is a perspective view of a treadmill with removed side covers in an inclined position.

FIG. 11 shows treadmill 60, with covers 65 and underlying stepping boards removed, oriented in an inclined position. The proximal ends of support bars 75 are shifted forward within slot 124 via an electric motor mechanism described below, causing support bars 75 to act against linkage bars 79 and the ground (via wheels 77) to raise the front of the treadmill.

Figure 12:
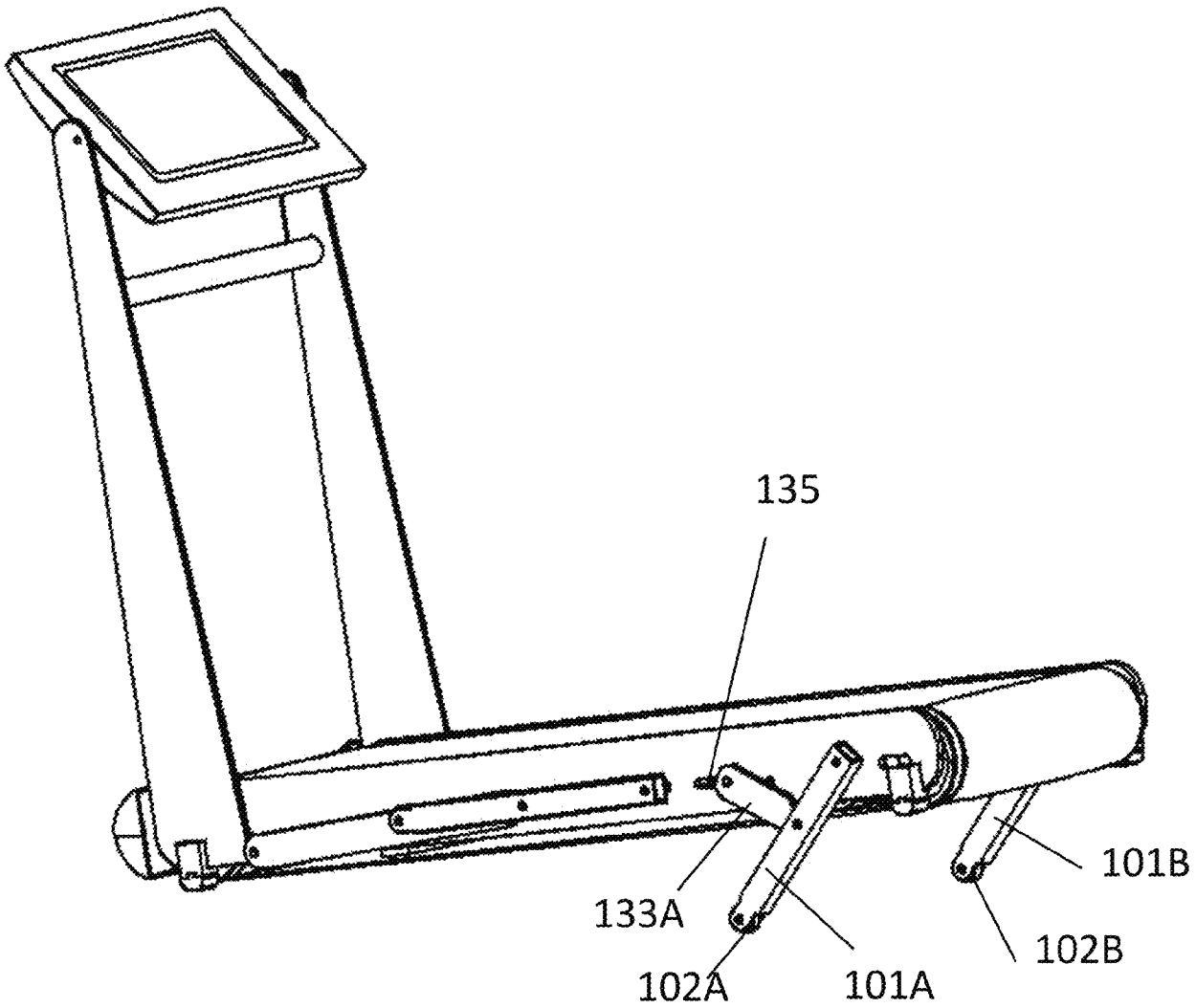
FIG. 12 is a perspective view of a treadmill with removed side covers in an declined position.

FIG. 12 shows deployment of the decline mechanism, with covers 65 and underlying stepping boards removed. While for the incline mechanism, the incline motor acts to move the incline support bars that rotate around fixedly hinged linkage bars, for the decline mechanism the action of the motor is reversed: the motor acts against the decline linkage bars, which in turn cause rotation of fixedly-hinged decline support bars. Specifically, the proximal ends of decline linkage bars 133 are shifted rearward along slot 135, formed within side rail 111. The distal ends of decline linkage bars 133 are hinged with, and act against, decline support bars 101 to force the distal ends of decline support bars 101 downwards, thereby lifting the rear of treadmill 60 upwards and creating a declination of belt 74 and its underlying deck relative to the ground.

Figure 13:
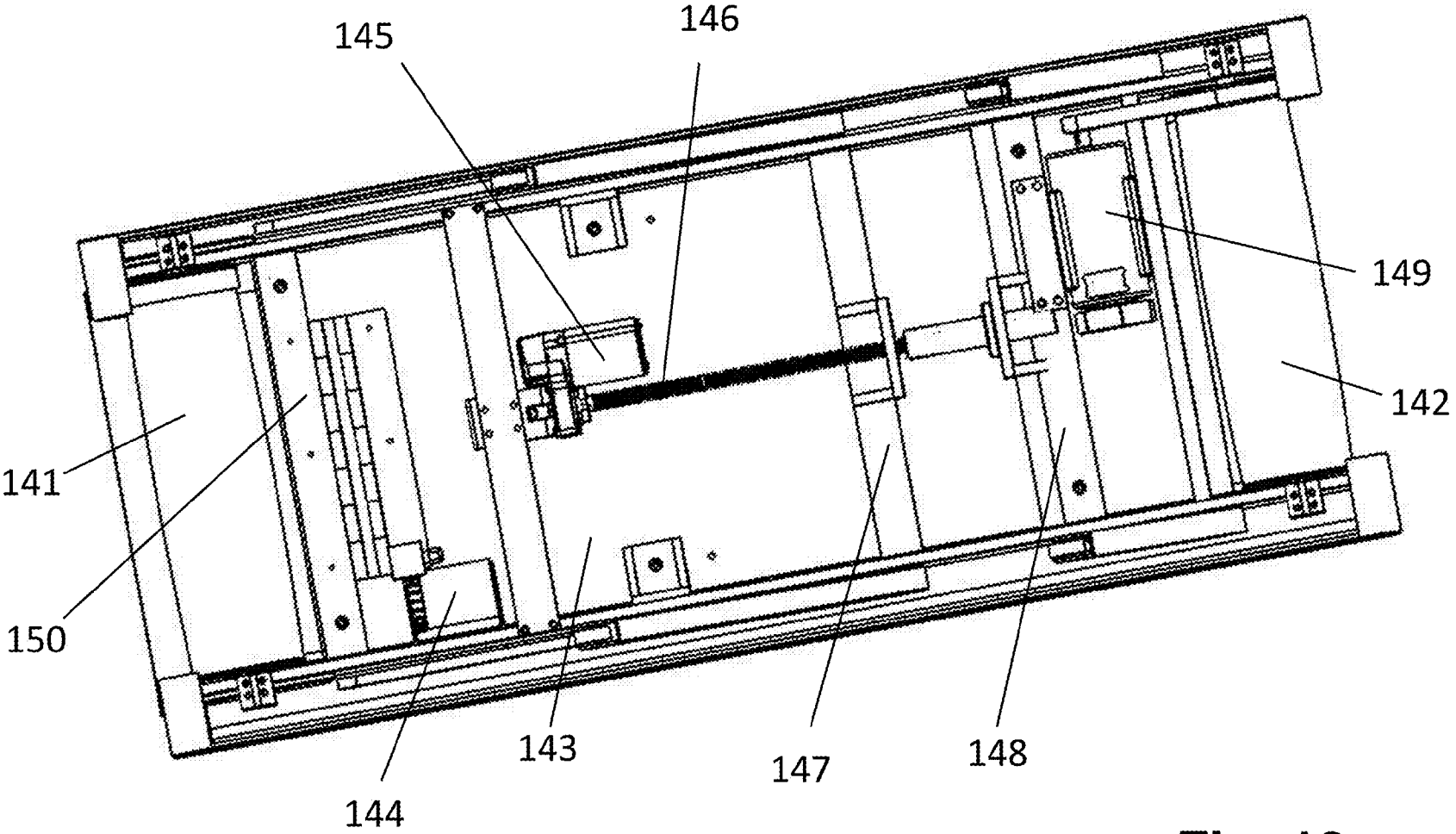
FIG. 13 is a bottom plan view of a treadmill with removed belt.

FIG. 13 is a bottom plan view of treadmill 60, with belt 74 removed to reveal the underside of the treadmill and its inclination/declination mechanisms. Surface 143 is the underside of the deck. Rollers 141 and 142 are the front and rear rollers for the belt, respectively. Another difference of treadmill 60 compared to many prior art treadmills is that rollers 141 and 142 have relatively larger diameter (e.g. twice the diameter compared to common prior art treadmills), enabling placement of key components (such as belt motor 149, incline motor 145, deck, and compressor 144) between the top and bottom of belt 74. Use of larger diameter rollers, in turn, result in lower rotational speeds to achieve the same belt speeds, thereby reducing noise and wear on roller bearings, while increasing component longevity. For example, a typical prior art treadmill may have rollers with a diameter between 1.5 and 3 inches. The architecture of the new treadmill of this invention enables rollers with a diameter between 7 and 9 inches. Larger diameter rollers may also provide greater contact area between the roller and belt, thereby reducing the likelihood of belt slippage on the roller.

Other components shown in FIG. 13 include the belt motor 149; the incline motor 145; the lead screw 146; movable incline crossbar 147; movable decline crossbar 148; and air compressor 144.

Figure 14:
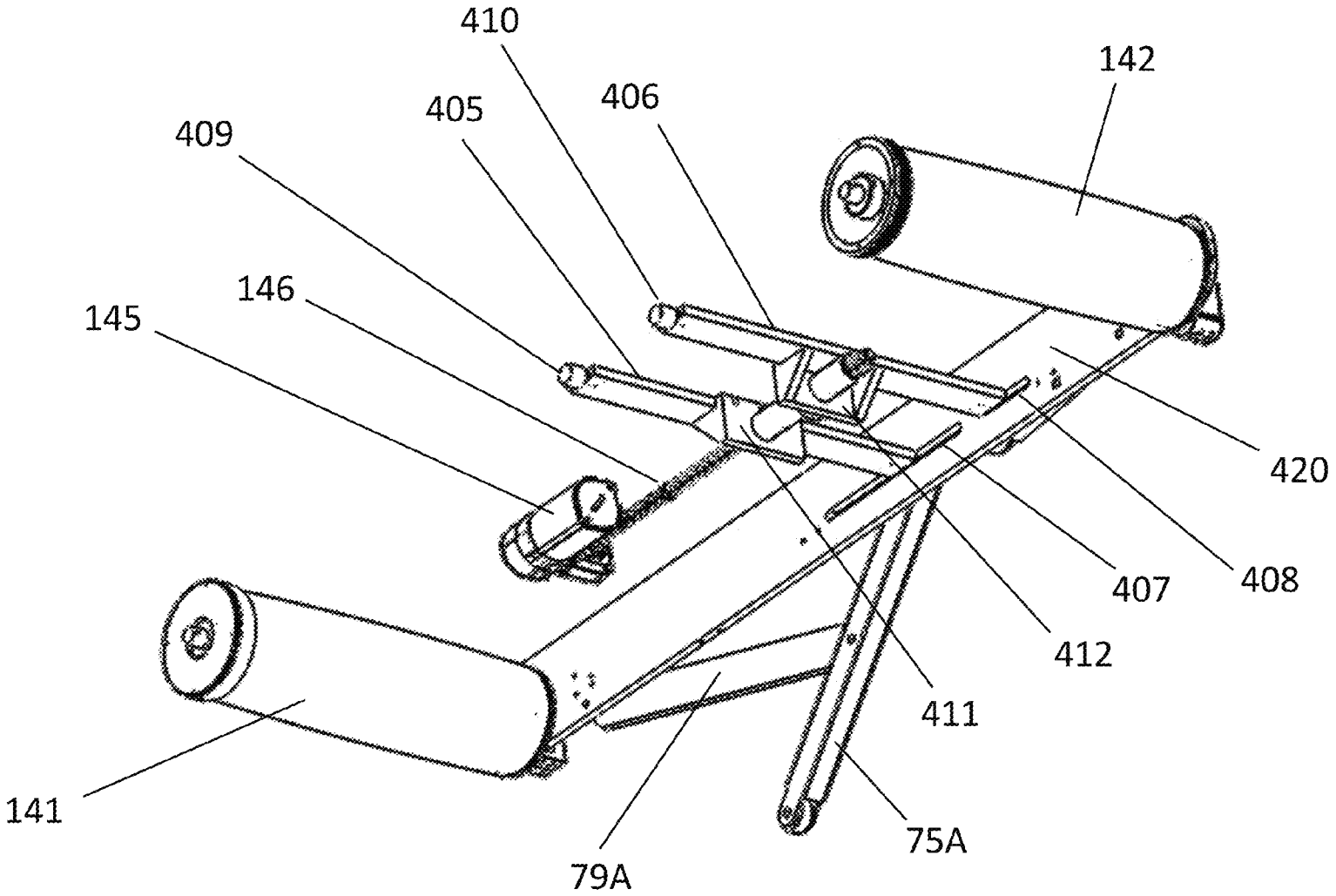
FIG. 14 is a bottom perspective view of an incline/decline mechanism.

FIG. 14 illustrates such an incline/decline mechanism in isolation from a bottom perspective view. The treadmill in this figure is shown with some components removed to better visualize the details of the mechanism. Roller 141 is the front roller, and roller 142 is the rear roller. The right structural rail is illustrated as rail 420, while the left rail has been removed in this figure. Rail 420 contains slot 407 for the incline mechanism and slot 408 for the decline function. Incline crossbar 405 has a roller 409 at each one of its ends, intended to allow the crossbar 405 to slide longitudinally back and forth along the rails, with the rollers 409 rotating inside incline slot 407 in right rail 420, and inside an analogous slot in the left rail (not shown). Similarly, decline crossbar 406 has a roller 410 at each one of its ends, allowing crossbar 405 to slide longitudinally along the rails, with the roller 410 rotating inside the slot 408, and an associated roller 410 on the opposite end of crossbar 406 rotating inside a slot in the left rail (not shown). Incline motor 145 causes the crossbars 405 and 406 to slide longitudinally by rotating lead screw 146, which mates with an incline mechanism control nut held by bracket 411 (for incline) and with a decline mechanism control nut held by bracket 412 (for decline). The rotation of the lead screw 146 can thus be used to longitudinally move the crossbars 405 and 406 as needed. In this figure the rotation of the lead screw would cause a longitudinal displacement of the crossbar 409 (the incline crossbar), which is pivotably attached to the previously described linkage bars 75A and 79A, thus causing their deployment and the incline lifting of the treadmill. The decline mechanism works the same way, with the corresponding linkage bars being deployed when the lead screw 146 reaches a nut in bracket 412 and causes the decline crossbar 406 to slide longitudinally rearward, deploying decline support bars 133 and 101 to lift the rear of the treadmill.

Figure 15:
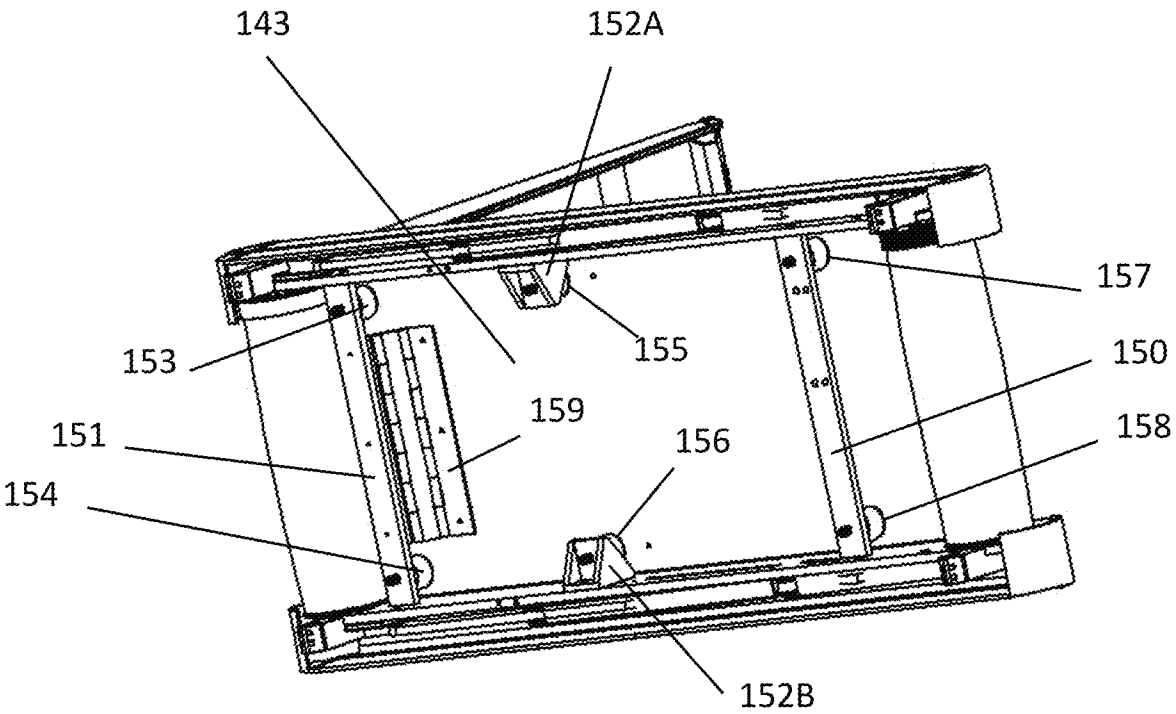
FIG. 15 is a bottom perspective view of a treadmill deck mounting apparatus.

FIG. 15 is another view of the underside of the treadmill, shown without belt 74 or the incline and decline mechanisms of FIG. 13, which will be used to describe how the deck is supported. Surface 143 is the underside of the deck. The weight of the deck is completely carried by air suspension elements, such as bellows, sometimes also referred to as air springs. Specifically, bellows 153, 154, 155, 156, 157 and 158 support deck surface 143. The bellows are inflated to the desired pressure by, e.g., a computer-controlled compressor (described below), or by a hand pump. Each bellow is attached on one end to the underside surface of the deck 143 and on its opposite end to a frame support mounted to the frame side rails, such as crossbar 151 (bellows 153 and 154), crossbar 150 (bellows 157 and 158), gusset support structure 152A (bellows 155) and gusset support structure 152B (bellows 156). A double-hinge 159 is also provided to maintain the deck centered in its lateral positioning, and to relieve the bellows from side loads and shear stresses that otherwise may occur. Double-hinge 159 is attached at one end to deck underside 143, and at the opposite end to crossbar 151, and preferably has a width that spans the majority of deck underside 143.

Figure 16:
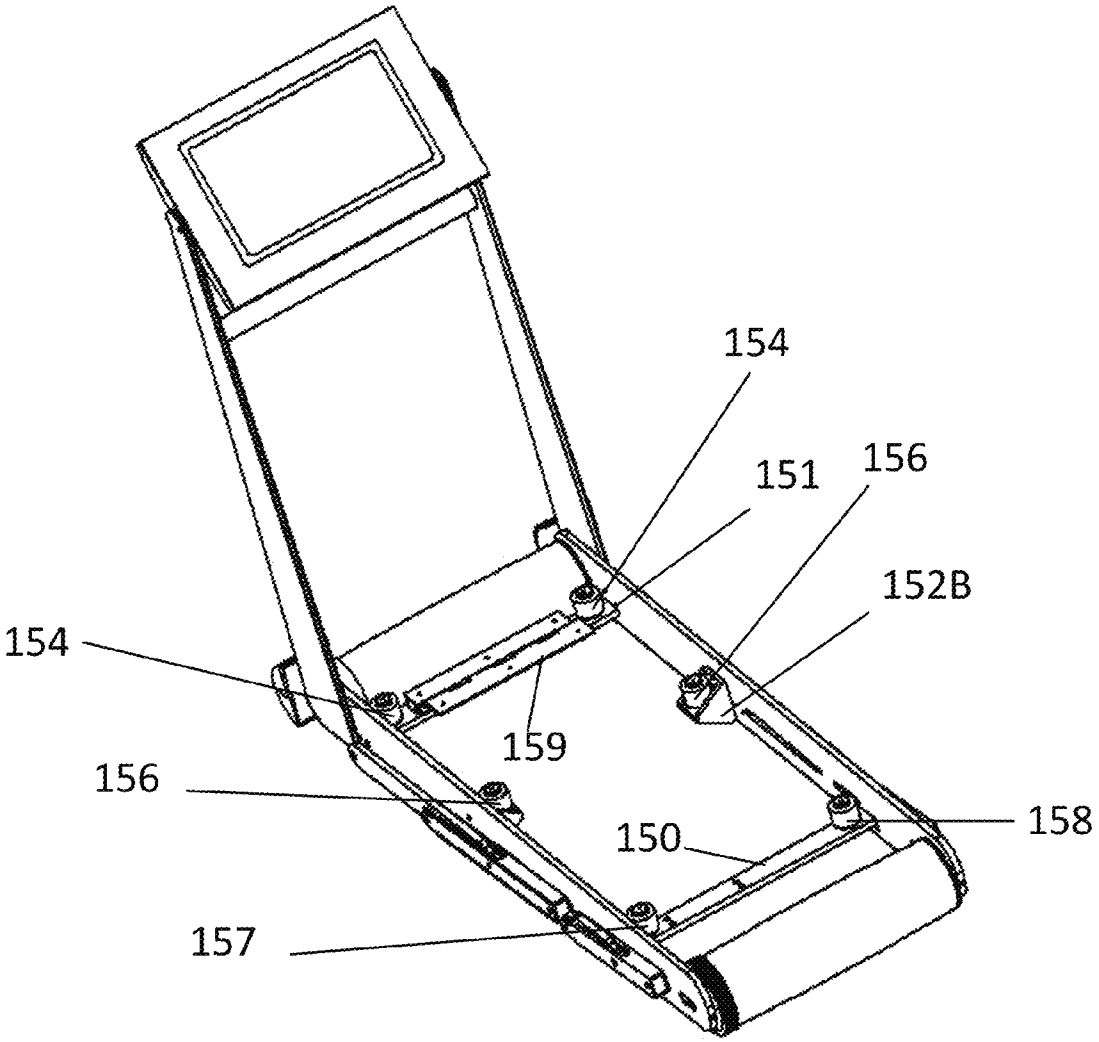
FIG. 16 is a top perspective view of a treadmill deck suspension.

FIG. 16 is a top perspective view of the embodiment of FIG. 15, with deck removed, further illustrating the treadmill suspension system. As described above, the deck is supported by the bellows 153, 154, 155, 156, 157 and 158.

Figure 17:
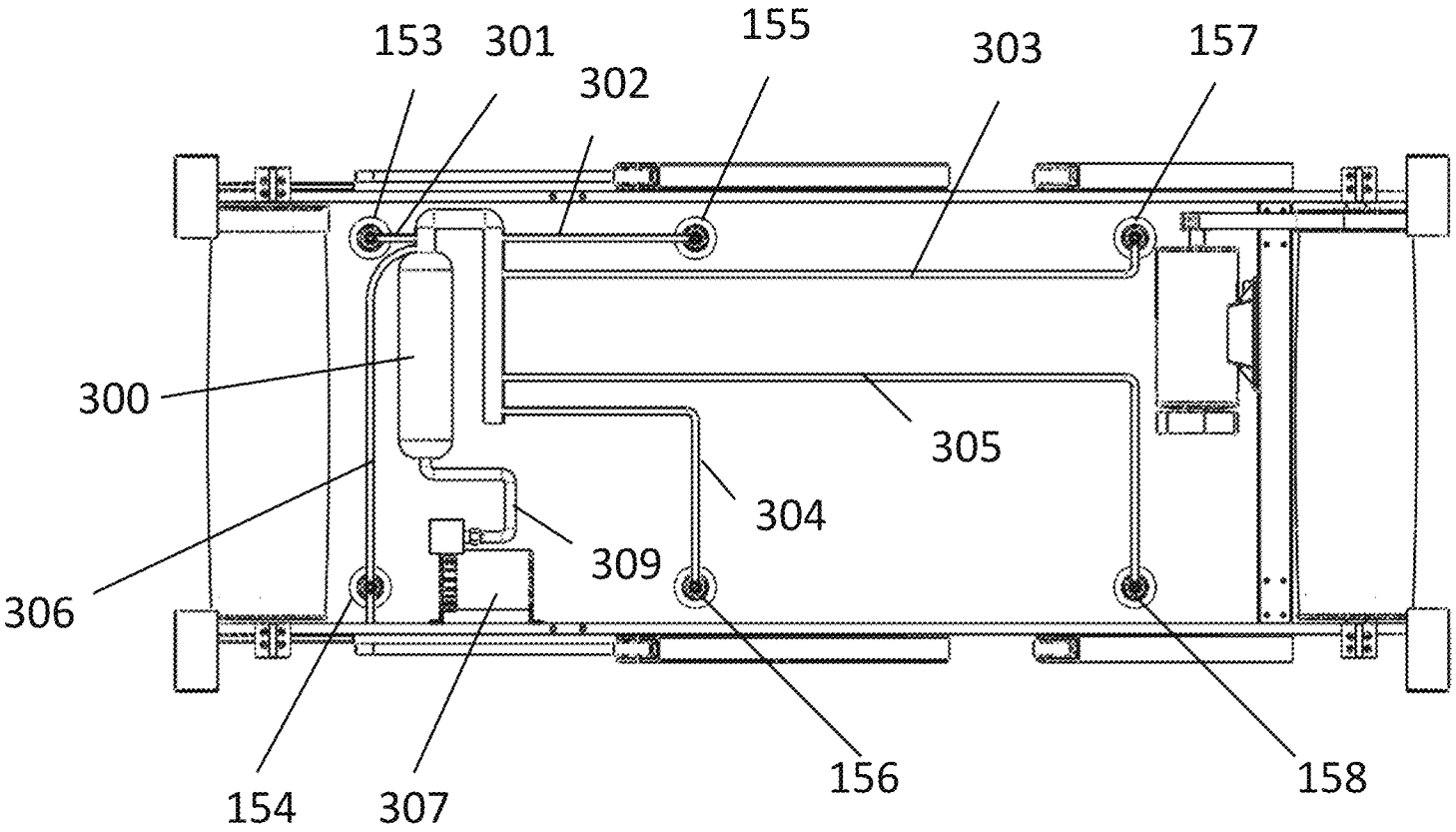
FIG. 17 is a bottom plan view of a treadmill air suspension system.

FIG. 17 is a bottom plan view of the treadmill suspension system, including a computer-controlled mechanism for bellow pressurization. The embodiment includes bellows 153, 154, 155, 156, 157 and 158; computer-controlled compressor 307; and a central reservoir 300. Compressor 307 pressurized central reservoir 300 via air hose 309. The air lines 301, 302, 303, 304, 305 and 306 connect each of bellows 153, 155, 157, 156, 158 and 154, respectively, to reservoir 300, helping ensure that the deck is supported by the same pressure at all points of support. An air pressure sensor may be mounted to monitor air pressure within the central reservoir 300 and/or one or more of bellows 153-158.

A purge valve may be provided within the pressurized system (e.g. within the compressor, reservoir, bellows, or an interconnecting air line) to reduce air pressure. The purge valve may be controlled by one or more factors including, for example, a mechanical pressure release mechanism actuated when pressure exceeds a maximum value, or an electronic control system.

In some embodiments, reservoir 300 is pressurized to a desired level based on user preference for ride firmness (as determined by the user through the touchscreen user interface). In such embodiments, a control signal may be provided to compressor 307 based at least in part upon a user-controlled configuration setting. In other embodiments, reservoir 300 pressure is determined algorithmically based upon input parameters which may include measurements like detected user weight, running speed, incline level and/or user impact levels; in which cases, controls signals based at least in part on one or more of those factors may be provided to compressor 307. User impact levels may be determined in a variety of ways, such as via a pressure transducer mounted to the deck, or via monitoring fluctuation in air pressure within the bellows or central reservoir using an air pressure sensor.

Figure 18:
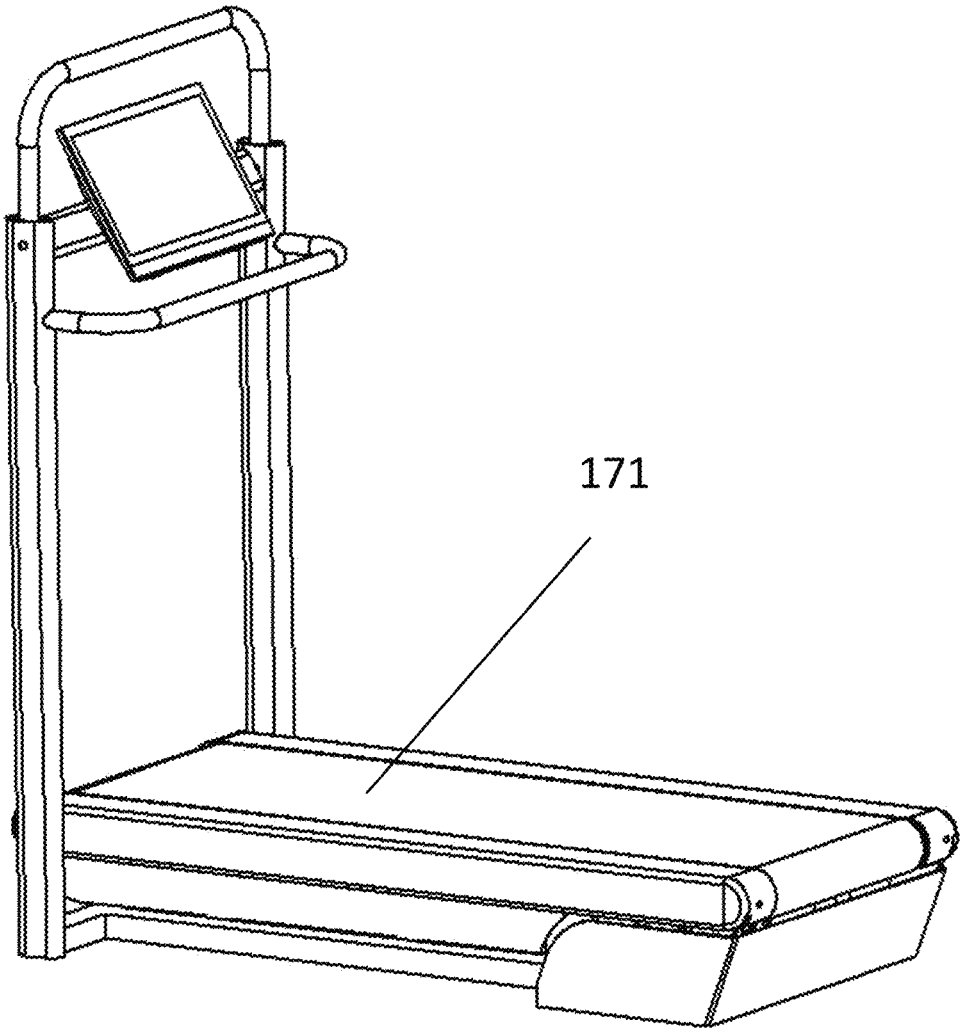
FIG. 18 is a perspective view of a treadmill embodiment with components positioned below the belt.
Figure 19:
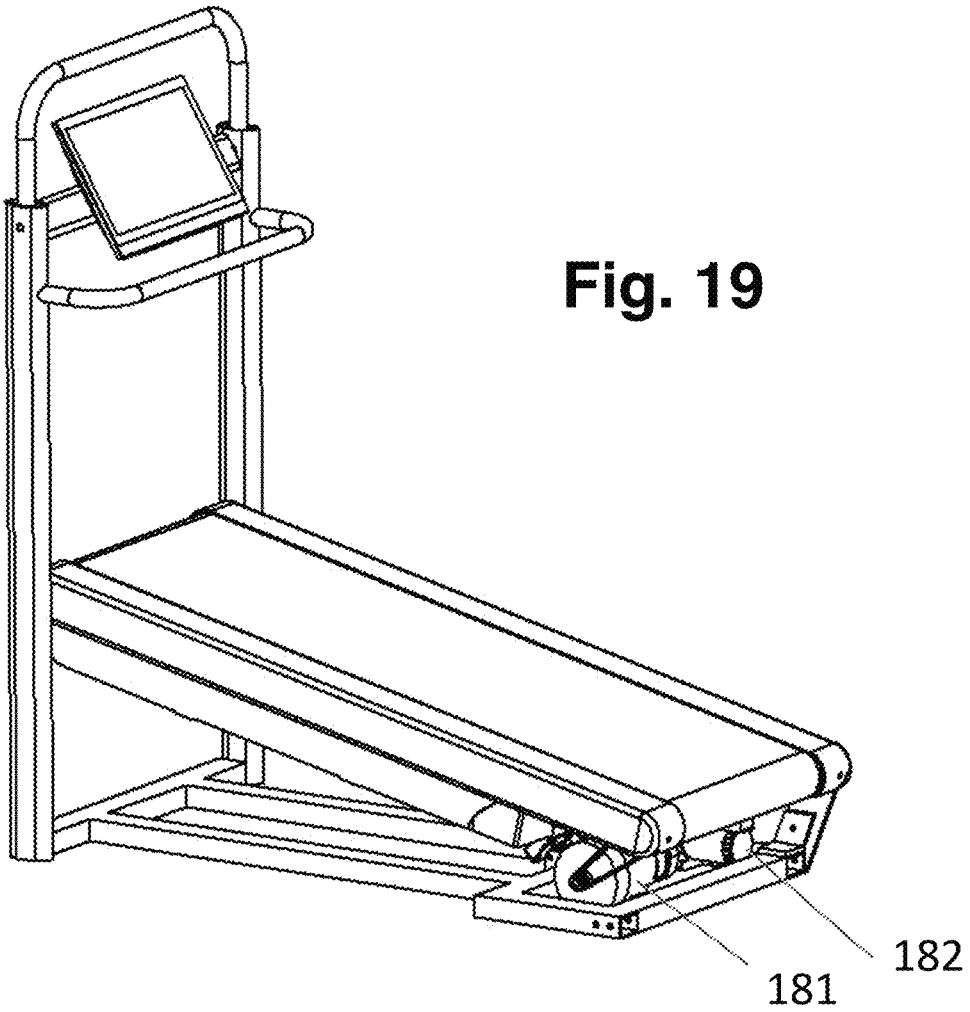
FIG. 19 is the treadmill of FIG. 18 in an inclined position.

FIG. 18 shows an alternative embodiment, in which the internal components are not contained within the belt circumference, but instead they are mounted beneath belt 171, while still providing a full air suspension for the treadmill running and walking surface. FIG. 19 shows the embodiment of FIG. 18, with the deck inclined, and with external covers removed to show some of the internal components. The belt motor 181 and the compressor 182 are now visible.

Figure 20:
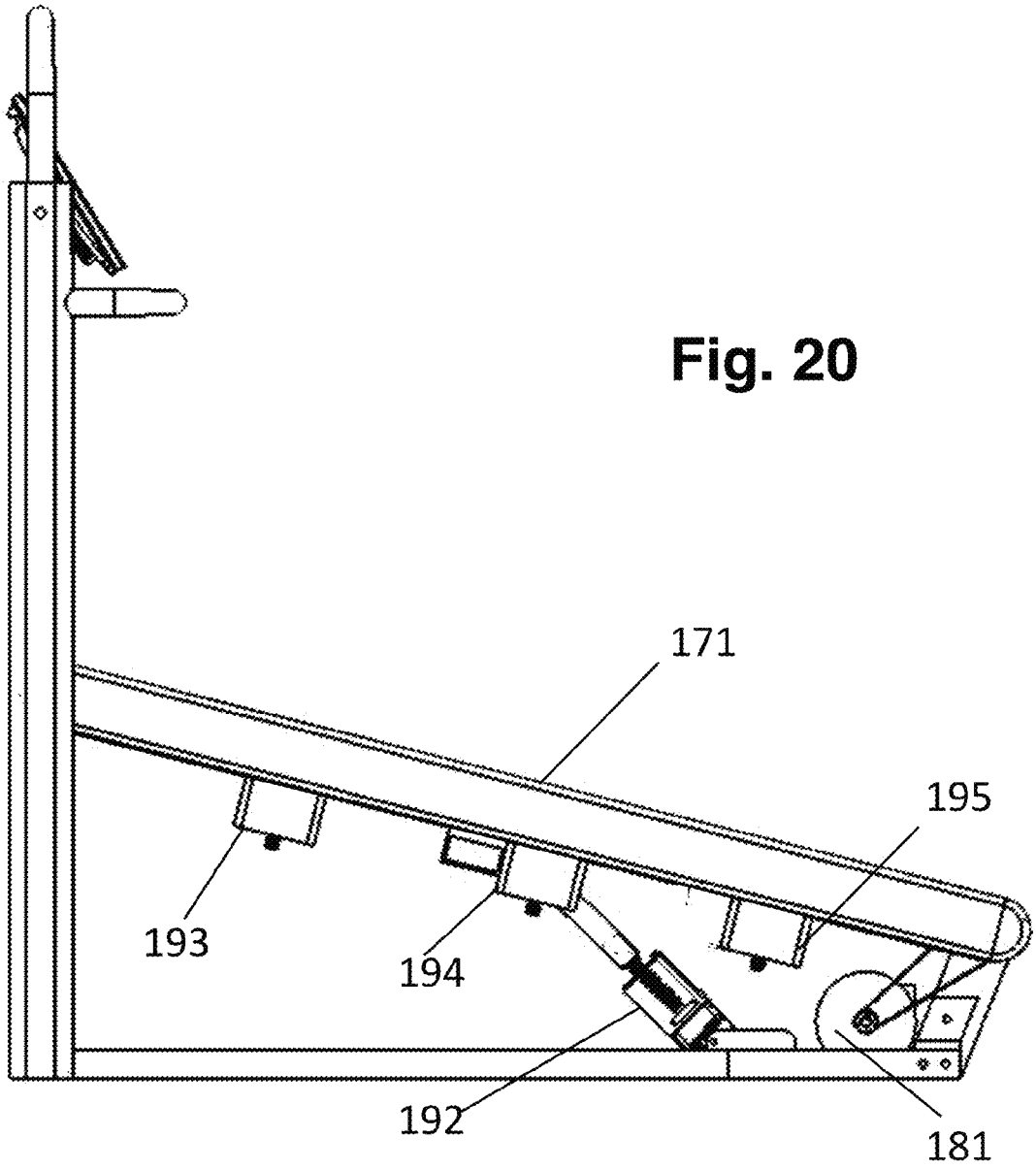
FIG. 20 is a side elevation cutaway view of the treadmill of FIG. 19.

FIG. 20 shows a side elevation of the treadmill of FIG. 18. Belt motor 181 drives belt 171. Incline motor 192 operates to control the incline to running surface 171. Left-side bellow support structures 193, 194 and 195, along with three matching bellow support structures on the right side of the treadmill (not shown), carry and support the deck. Bellow support structures 193, 194 and 195 are constructed analogously to gussets 152 in FIG. 16, providing a solid frame mounting point for air-filled bellows, with the deck fully suspended on the air-filled bellows.

Figure 21:
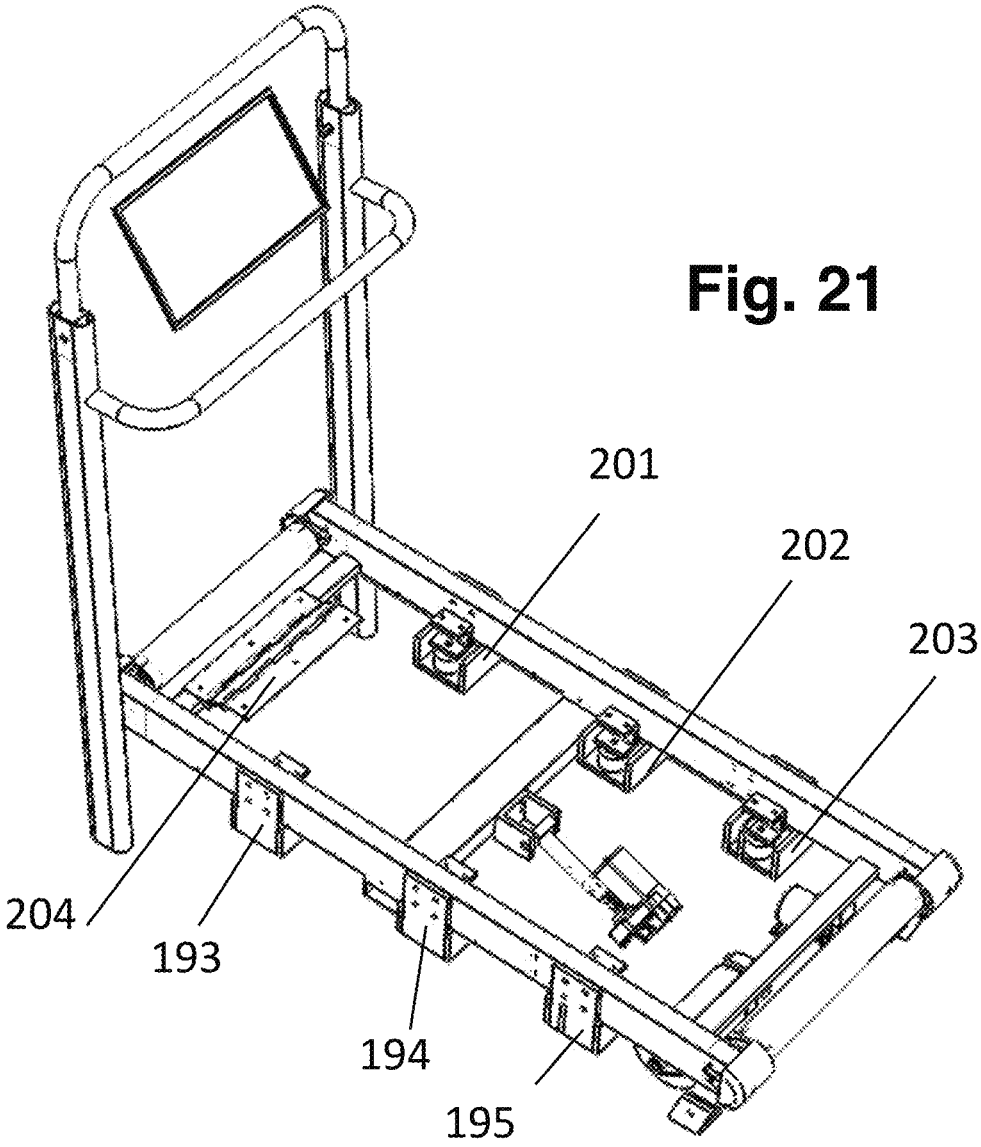
FIG. 21 is a perspective view of the deck suspension in the treadmill of FIG. 18.

FIG. 21 is a perspective view from the top of the treadmill, with the belt and the deck removed for clarity. Left side bellow support structures 193, 194 and 195 are complemented by right side bellow support structures 201, 202 and 203. Each bellow support structure has a bellow mounted thereon. The deck (not shown for clarity) rests on these six bellows. The double hinge structure 204 operates analogously to hinge 159 in the embodiment of FIG. 14, helping reduce or eliminate side loads on the bellows.

While preferred embodiments illustrated herein utilize six bellow to support the deck, with front, middle and rear bellows on each of the left and right sides of the deck, it is contemplated and understood that differing quantities and positions of bellows could readily be implemented. For example, cost and build complexity may be reduced by utilizing four bellows, with one positioned at each corner of the deck.

Figure 23:
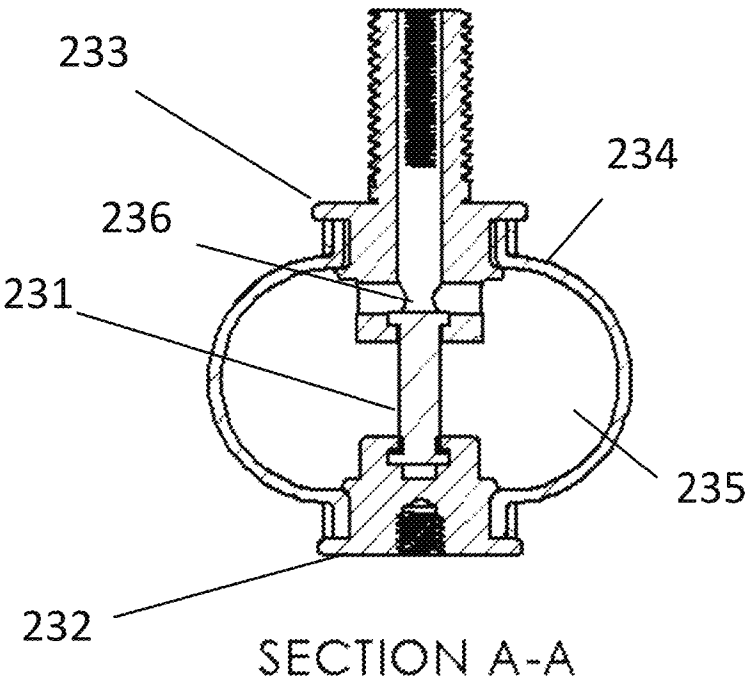
FIG. 23 is section A-A of the air suspension element of FIG. 22.
Figure 22:
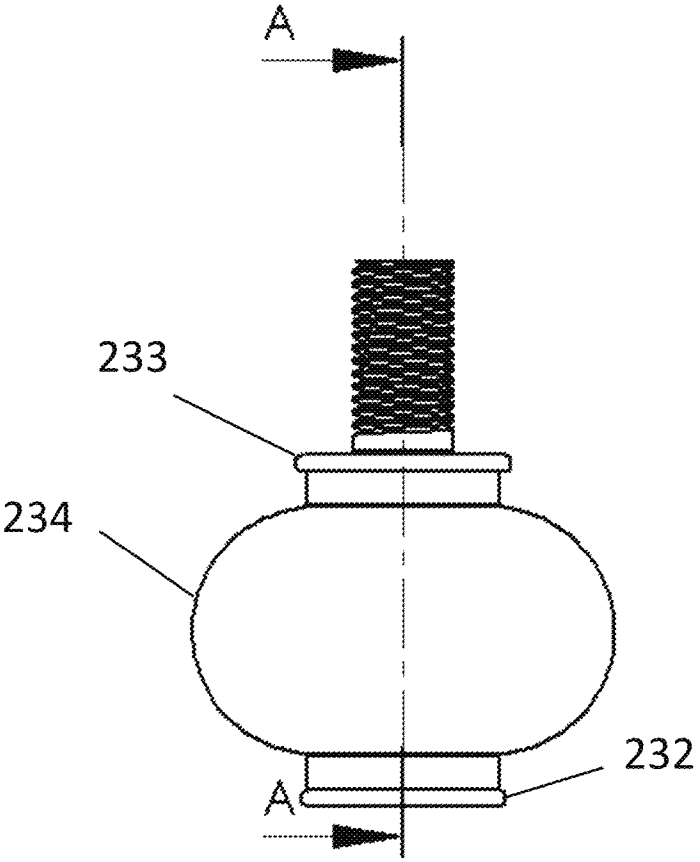
FIG. 22 is an elevation of an air suspension element, according to an embodiment.

FIG. 22 is an elevation view of an improved bellows mechanism that has a built-in feature to prevent the bumpiness that can result from having inflated, pressurized bodies like bellows under the deck. FIG. 23 is a cross-section of the bellows of FIG. 22, taken along plane A-A. Top fitting 233 and bottom fitting 232 are connected internally by connecting member 231. Bellows diaphragm 234 spans top fitting 233 and bottom fitting 232, is formed from an elastic material, and encapsulates an air chamber 235. Channel 236 provides a route for pressurization of air chamber 235 through top fitting 233, such as via the compressor, central pressure canister and tubing assembly described elsewhere herein.

Preferably, connecting member 231 is configured to allow fittings 232 and 232 to come closer to one another with little resistance during compression, allowing the air pressure within the bellows chamber to exert an opposing force; meanwhile, connecting member 231 will preferably exert an opposing or limiting force during expansion of the bellows to dampen the expansion. In some embodiments, member 231 can be an elastic strap. In other embodiments, member 231 can be formed from a fabric strap.

Figure 25:
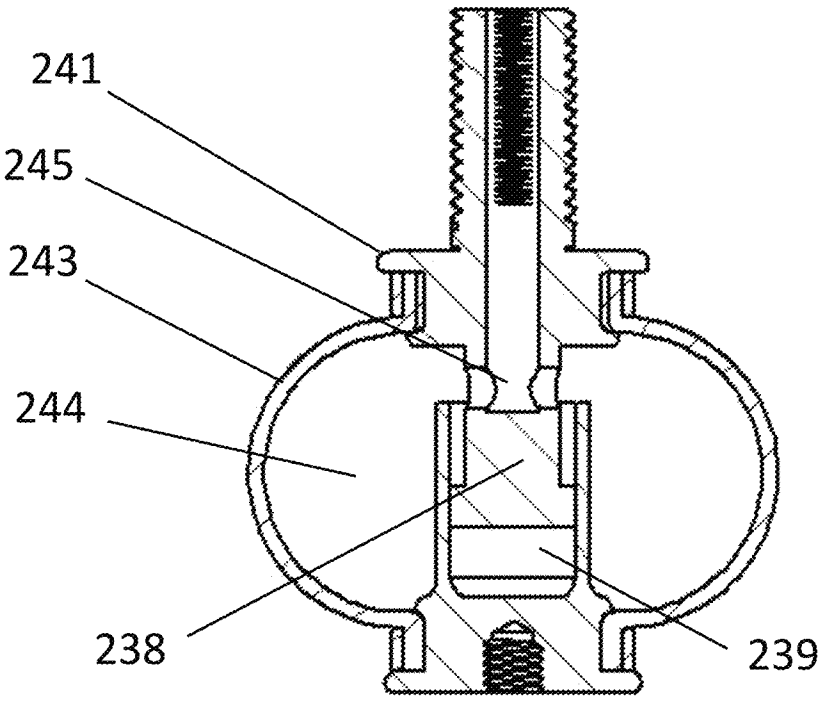
FIG. 25 is section A-A of the air suspension element of FIG. 24.
Figure 24:
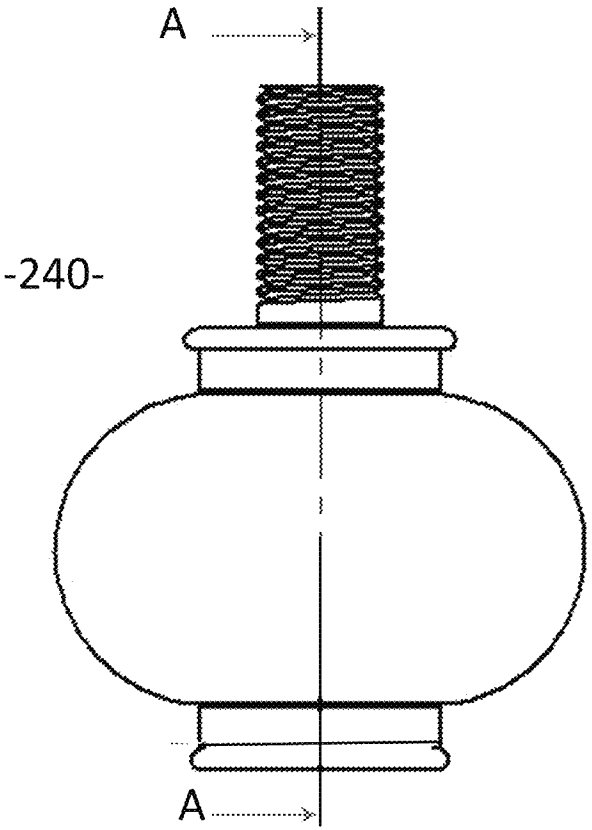
FIG. 24 is an elevation of another air suspension element embodiment.

FIG. 24 shows an alternative bellows mechanism 240, having a frictional damping element. FIG. 25 is a cross-section of the bellows of FIG. 24, taken along section A-A. Bellows 240 includes upper fitting 241 and lower fitting 242. Bellows diaphragm 243 spans upper fitting 241 and lower fitting 242, and encapsulates air chamber 244. Air channel 245 extends through upper fitting 241 to enable pressurization of the bellows. The lower portion of upper fitting 241 includes piston 238. The upper portion of lower fitting 242 forms receptacle 239. Bellows movement is dampened by friction of piston 238 within receptacle 239.

In some embodiments, the damping structure of FIGS. 24-25 can be implemented as a hydraulic dampener. Receptacle 239 may be formed as a closed, oil-filled chamber, divided into two sections by piston 238. Oil would be permitted to flow between either side of piston 238 via a small, restrictive orifice, and a one-way check valve providing less resistance to oil flow than the restrictive orifice when upper fitting 241 and lower fitting 242 are moved towards one another. Thus, the piston mechanism provides comparatively little resistance to compression of the bellows, but greater resistance to expansion, thereby dampening the bellows.

Figure 26:
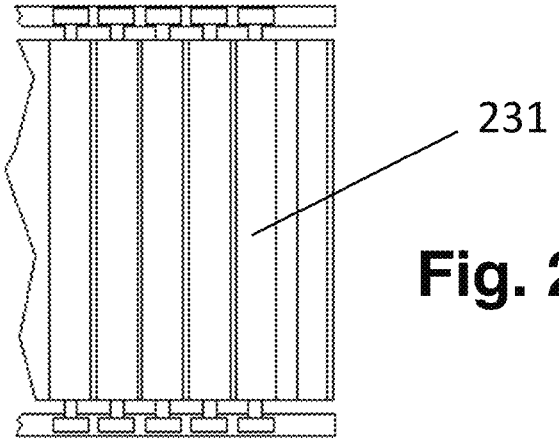
FIG. 26 is a partial top plan view of a deckless treadmill embodiment.
Figure 27:
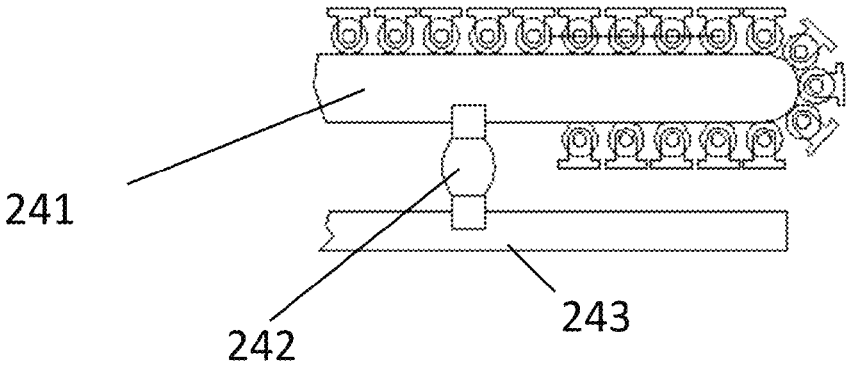
FIG. 27 is an elevation of the embodiment of FIG. 26, with covers removed and suspension exposed.

In other embodiments, a deckless treadmill design replaces a flexible belt with a series of adjacent slats extending across the treadmill perpendicularly to the direction of travel, to form a running surface. Deckless treadmill embodiments can still beneficially utilize variations of the suspension systems described herein. For example, FIG. 26 is a cutaway top view of the rear portion of a treadmill that does not have a deck. Self-supporting slats 231 are sufficiently rigid to support the weight of a user, without a solid deck underneath. The cutaway side view in FIG. 27 shows that the slats run on a guide 241. Slats 231 and guide 241 can all be carried and supported by a set of bellows 242, mounted on frame 243.

Figure 28:
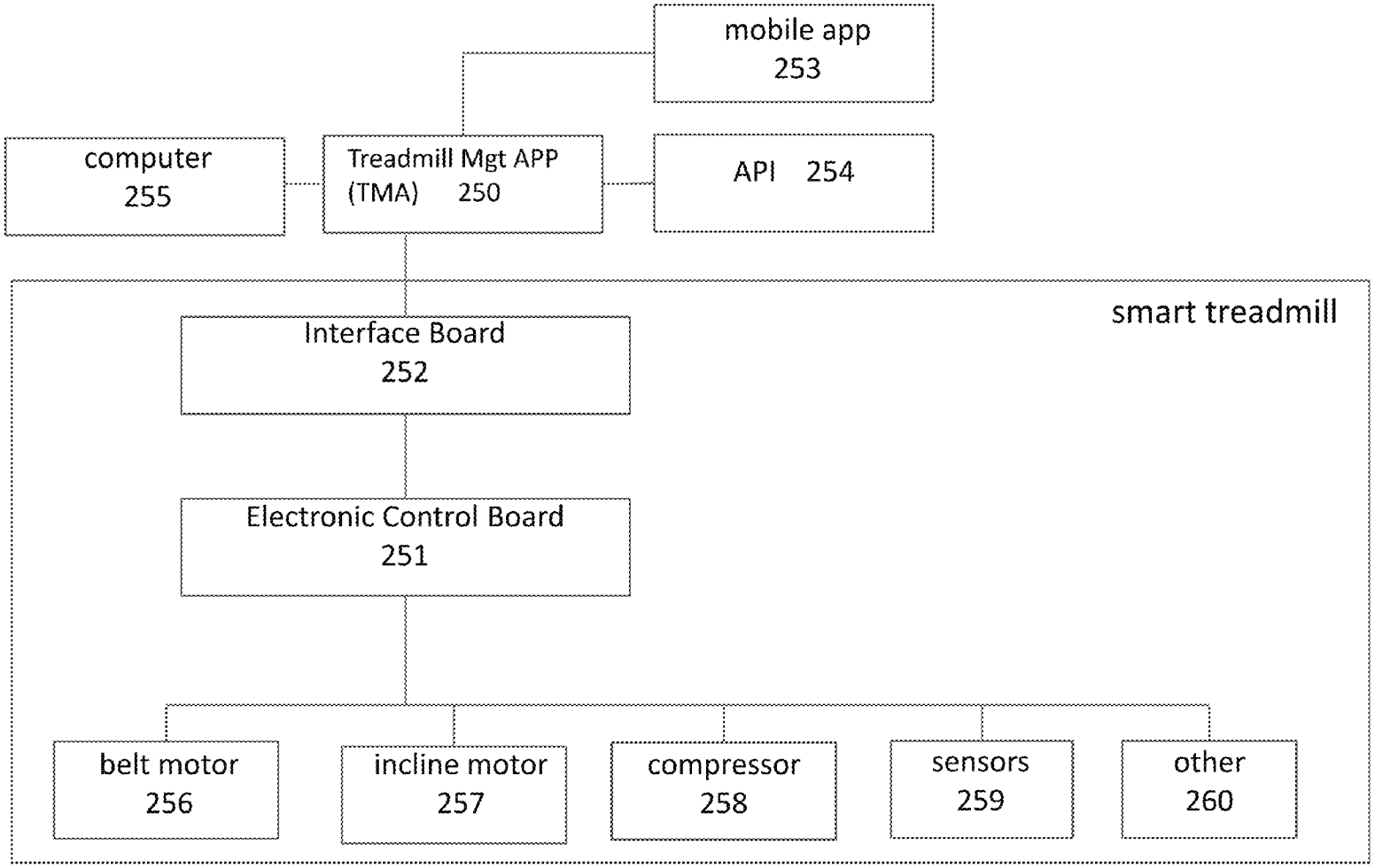
FIG. 28 is a schematic block diagram of a computerized treadmill control system.

Preferably, the treadmill is managed by a computer, as opposed to typical prior art treadmills run by embedded controls and dedicated circuits with little or no programming flexibility. In accordance with one such embodiment, FIG. 28 illustrates a schematic block diagram of a control mechanism for the treadmill. The Treadmill Management Application 250 is a computer program executed on computer 255, which gives instructions to Electronic Control Board 251 through Interface Board 252. Electronic control board 251 is a circuit board that provides electronic control signals to govern the operation of belt motor 256, incline motor 257, compressor 258, sensors 259, and other electronic or electromechanical mechanisms 260.

Interface board 252 preferably provides a digital interface between computer 255 and control board 251. In some embodiments, interface board 252 includes an external connector or dock with physical electronic interconnect, adapted for connecting the treadmill with an external computer 255, such as a laptop computer, tablet computer or smart phone. In some embodiments, interface board 252 may include a wireless transceiver implementing a wireless communication link between control board 251 and computer 255, such as a wireless Ethernet connection, or a Bluetooth connection.

TMA 250 also communicates with mobile app 253. Through Applications Programming Interface (API) 254, TMA 250 enables third parties (such as game developers and exercise program developers) to develop software for the smart treadmill. In some embodiments, computer 255 is provided with and physically integrated with the treadmill, such as a tablet computer mounted within the treadmill display. In other embodiments, computer 255 is a modular component that can be alternatively attached to and detached from the treadmill. In yet other embodiments, computer 255 may be completely detached from the treadmill, such as a smart phone executing a dedicated treadmill management application and communicating with the treadmill (i.e. interface board 252) via a wireless communications protocol such as Bluetooth. Use of non-dedicated user computing hardware to operate the treadmill may be beneficial, such as reducing treadmill cost by avoiding the cost of an integral computer.

Figure 29:
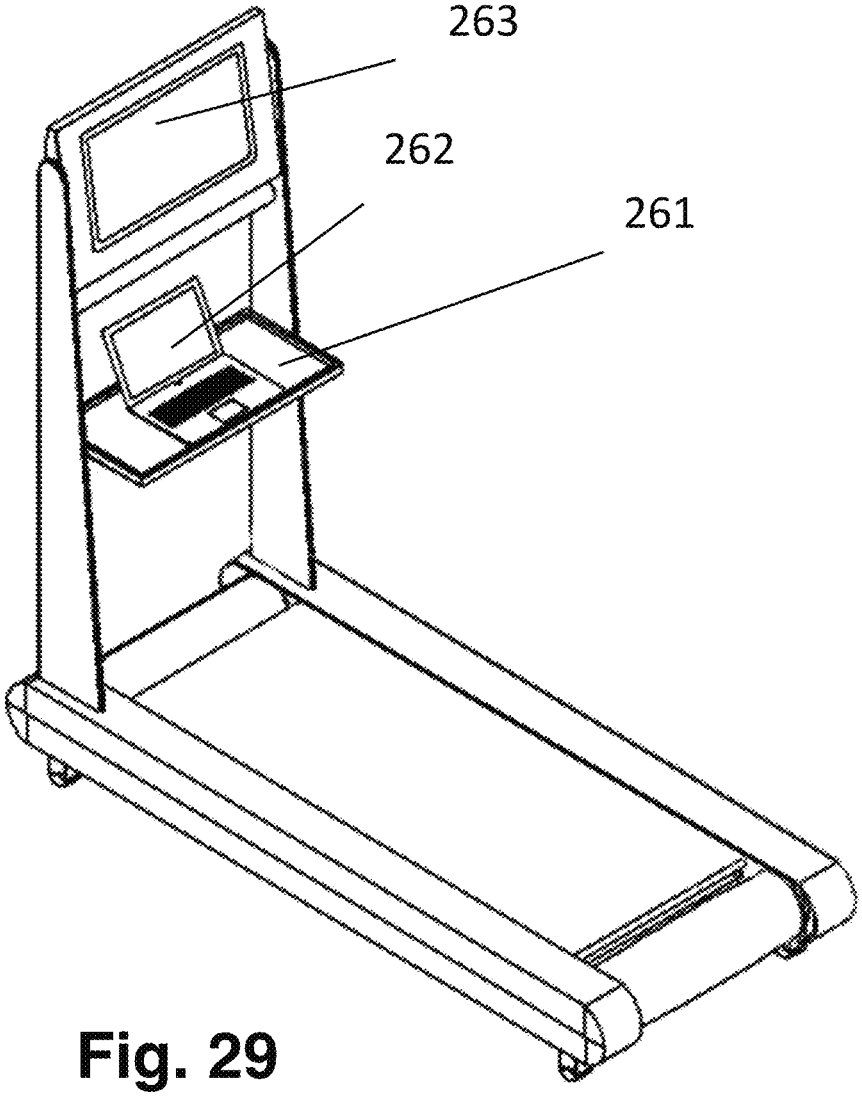
FIG. 29 is a perspective view of a treadmill with computer dock.

FIG. 29 shows an embodiment of a computer-driven treadmill in which a non-dedicated computing device is used for treadmill management. The treadmill of FIG. 29 is equipped with a dock 261, which can be shaped like a tray that can receive and hold computer 262. Optionally, the dock includes connectors adapted for communication with computer 262, enabling computer 262 to interact with integrated display 263, and all other peripherals available to the internal Interface Board, which in turn connects with the Electronic Controller Board that runs the treadmill devices and sensors. Computer 262, when connected with the dock, can take full control of the treadmill, and even run applications and software resident on the laptop.

Figure 30:
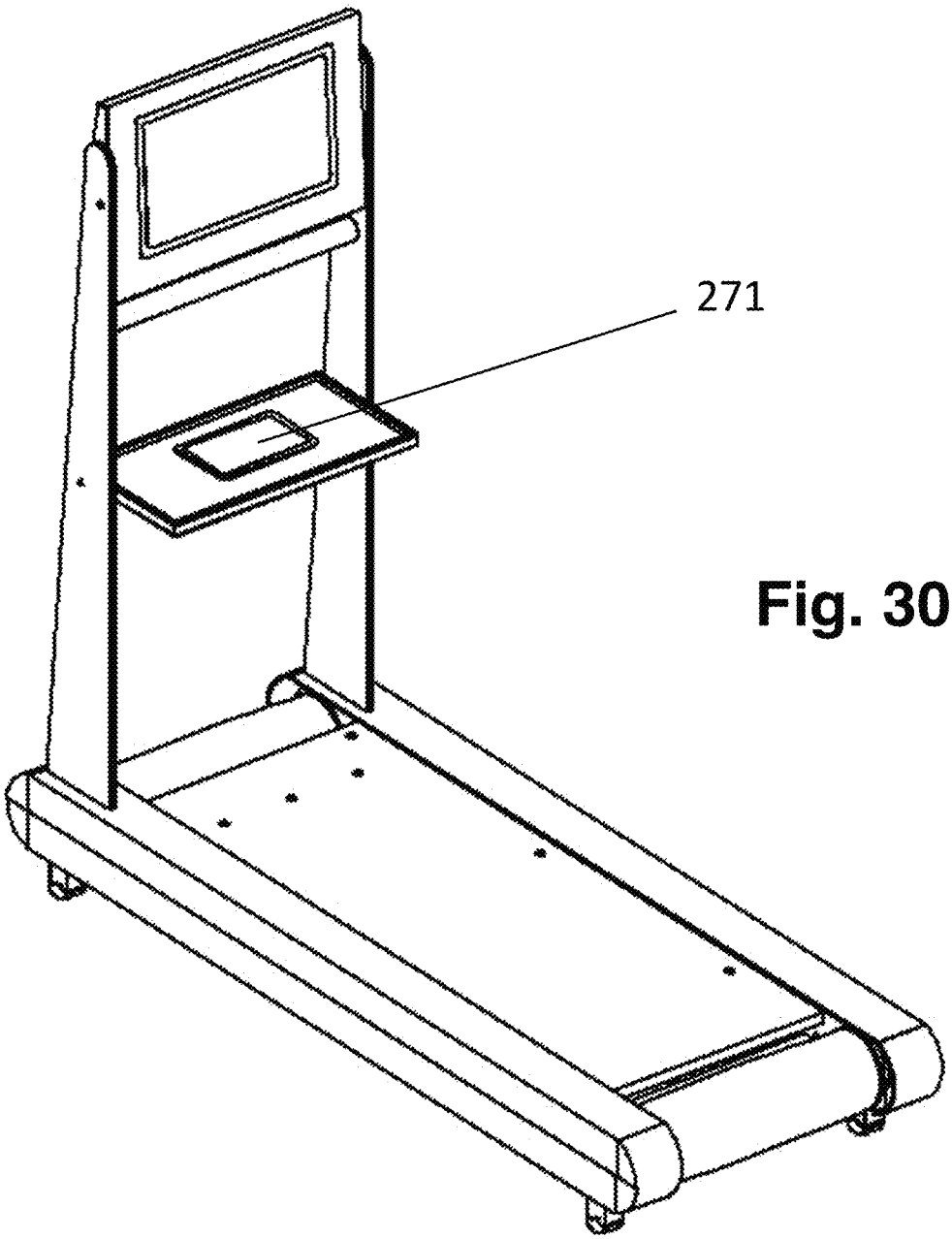
FIG. 30 is a perspective view of a treadmill with tablet computer dock.
Figure 31:
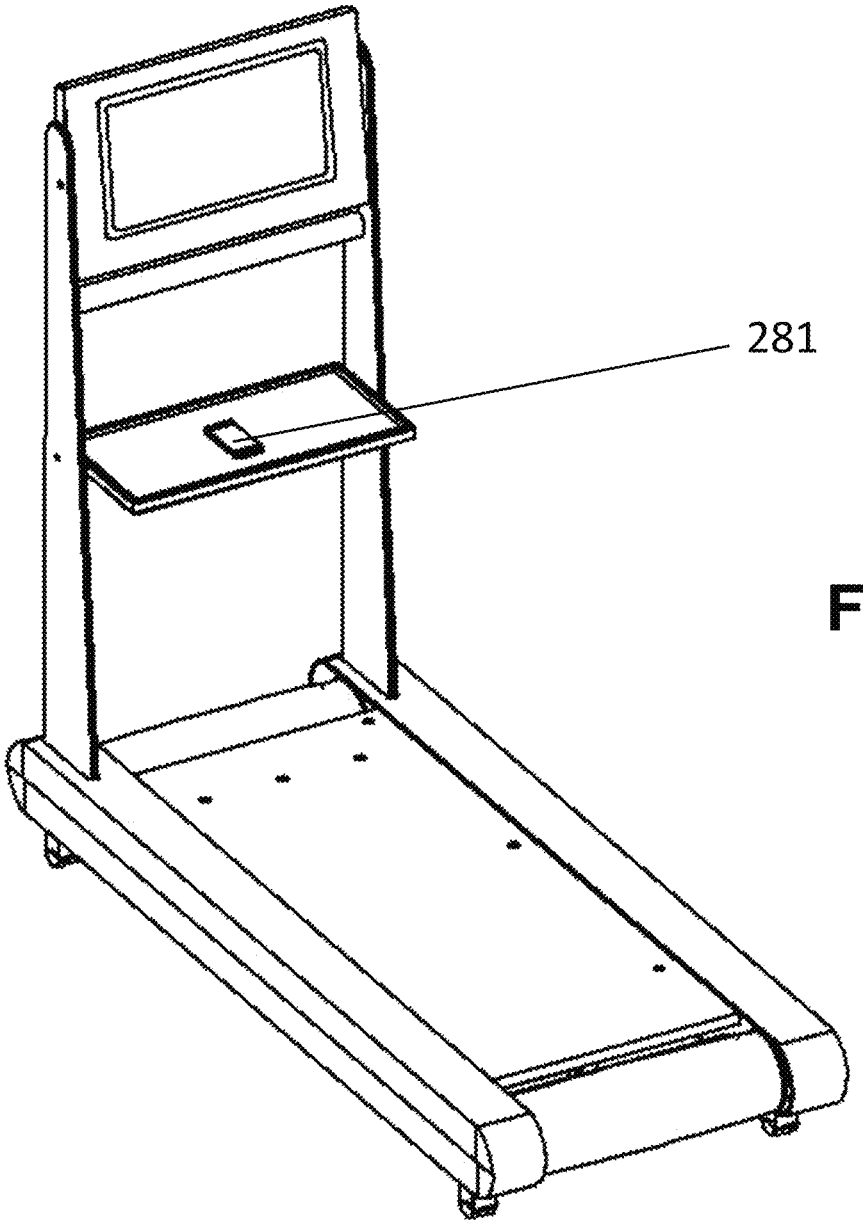
FIG. 31 is a perspective view of a treadmill with a smart phone dock.

In another embodiment, illustrated in FIG. 30, tablet computer 271 can be connected to the treadmill to control and manage the treadmill operation, as described above. In another embodiment, illustrated in FIG. 31, smart phone 281 can be connected to the treadmill to control and manage the treadmill operation, as described above. The connection of computer 262, tablet computer 271 or smart phone 281 to the dock can be through dock connectors, or through regular cables and wires, or wireless communication protocol. Particularly in case of wireless docking, a tray or other physical holding structure is optional.

The full computerization of the treadmill in this invention opens up an enormous number of possibilities for new types of exercises and activities, on and off-the-treadmill, where the treadmill can assume a key role as coach, manager, record keeper, motivator and administrator of a fitness, weight, health and lifestyle program, where the mobile app enables these services to be provided not only on or at near proximity to the treadmill, but virtually anywhere. For example, a smart phone application can not only control embodiments of the treadmill described herein, but also integrate the treadmill utilization and exercise data with a comprehensive health and fitness application that tracks user steps via an integrated smart phone motion sensor, logs user nutritional intake, logs user weight data, sleep patterns, and other information. In other embodiments, third party health and fitness applications can be provided with software to control and/or exchange information with the computerized treadmill. These and other applications are contemplated and enabled by the novel systems and devices disclosed herein.

Additionally, while the externally-controlled embodiment of FIGS. 28-31 are illustrated in the context of a treadmill, it is contemplated and understood that other embodiments may be implemented in the context of other types of exercise equipment, such as a stationary bicycle, elliptical machines, stepping machines and rowing machines. In each case, the exercise equipment includes electronic and electromechanical components that may be controlled by the controller board structure of FIG. 28, interfacing with an external computer. In some embodiments, TMA 250 may be implemented to control multiple types of exercise equipment using a common user interface design, thereby allowing users to move their computing device between different pieces of exercise equipment. Potential benefits of some embodiments of this arrangement include the ability to carry performance data between different pieces of exercise equipment by using a common computing device; and providing a common user interface with the exercise equipment, thereby reducing a user's learning barrier in using a different piece of equipment.

Figure 32:
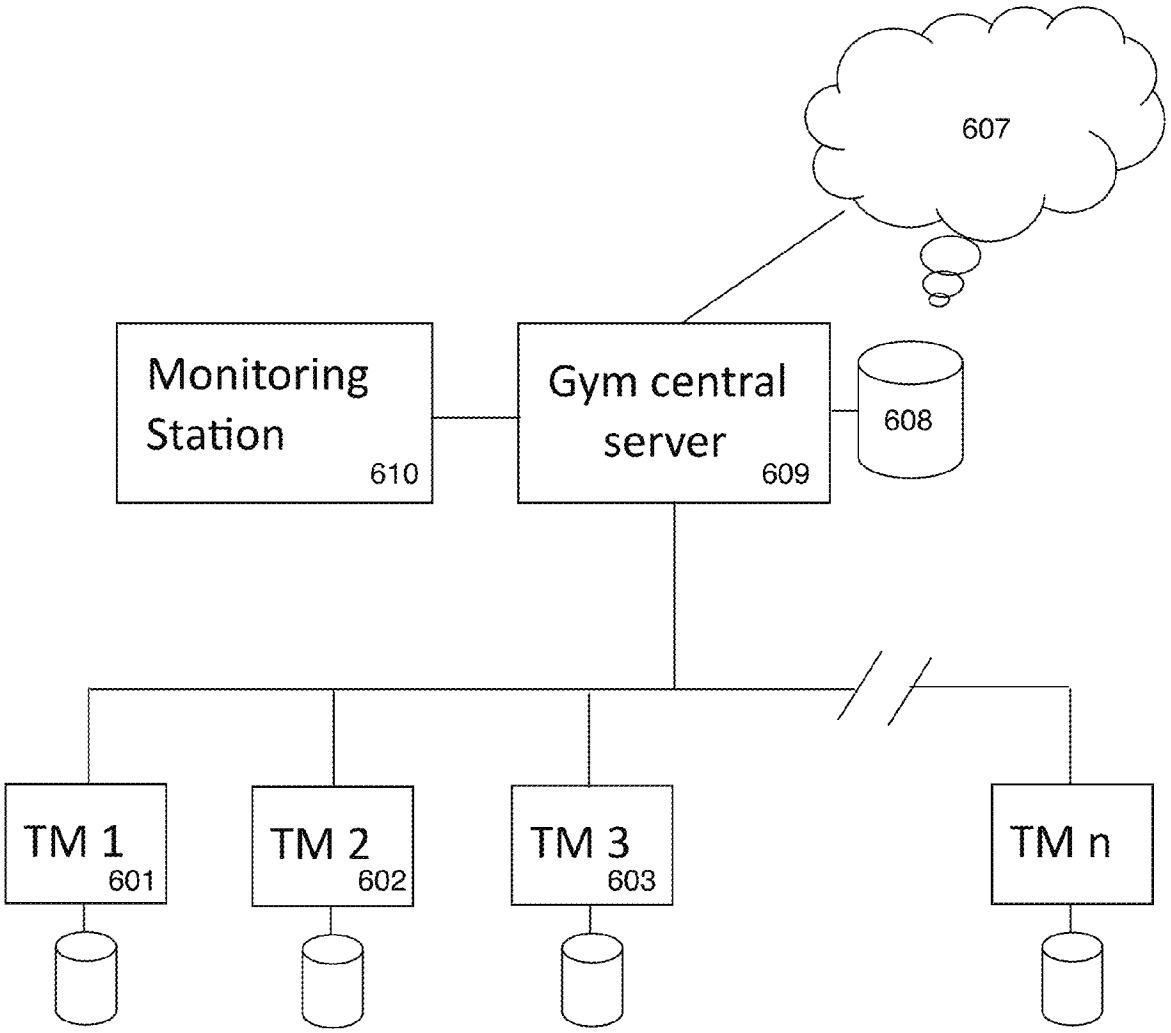
FIG. 32 is a schematic block diagram of a digital communications network for exercise machines.

FIG. 32 illustrates a further embodiment wherein each computerized piece of exercise equipment, such as treadmill 601, treadmill 602 and treadmill 603, has its own storage device 604, 605 and 606, respectively, which can be used to download large files which may be too bandwidth-intensive to stream live simultaneously. With complete computerization of treadmills and exercise equipment, gyms and similar facilities with a large number of computerized exercise machines will face the problem of potentially excessive bandwidth demand if a large number of users start streaming live entertainment such as movies on their machines at the same time. The gym could just increase its Internet bandwidth, but that may come at a high cost. The Exercise Network (gymrnet) of FIG. 32 addresses that problem. The gymnet is based on central server 609, which is in communication via an Internet connection with cloud providers of digital media, such as files or streamable services from providers such as Netflix, Amazon, HBO, and others, as well as Cable TV providers (who may be on the cloud or physically linked to the central server or in satellite communication with the central server). The central server 609 downloads the contents to its own storage device 608. When the high demand arises from the users, central server 609 can upload complete entertainment files (as opposed to live streaming them) to the local storage devices such as 604, 605 and 606, thereby reducing user impact from transitory network congestion or other interruptions. The communication network between the central server and the individual machines can be wired or wireless. The local machines 601, 602 and 603 can then locally play the entertainment files form their own storage devices, without a need to rely on live streaming from the cloud, and therefore avoiding bandwidth bottlenecks, whether in the cloud or local network. Other variations of this arrangement can also be implemented, such as live streaming from central server 609 to the individual machines, especially if the individual machines are physically connected to a common high speed data network with the central. The gym can have a large number of entertainment files always loaded on its storage unit 608, so that at any time the users can play those files even if the communication with the cloud is bandwidth-challenged or completely down.

Monitoring Station 610 is a great advantage for the gym as well, providing a user interface with server 609 that can be utilized by, e.g., gym management. Server 609 is preferably configured to retrieve information from all networked exercise machines and monitor them live, reporting and recording key status parameters (motor temperature, usage statistics, vibration status, hours in operation, upcoming service needs, biometric of users, medical emergencies and other relevant parameters) that represent key management data for the efficient and safe operation of the gym. The gym manager should be able to see the status of any machine on a screen provided by monitoring station 610, in real-time or near-real time, as well be alerted instantly of any situation that requires attention. Alerts can be issued at the monitoring station and also optionally on a mobile device such as a tablet or smart phone, so that management, service personnel and even medical personnel can be alerted if the need arises.

While certain embodiments of the invention have been described herein in detail for purposes of clarity and understanding, the foregoing description and Figures merely explain and illustrate the present invention and the present invention is not limited thereto. It will be appreciated that those skilled in the art, having the present disclosure before them, will be able to make modifications and variations to that disclosed herein without departing from the scope of any appended claims.

What is claimed is:

1. A treadmill comprising:

a rigid treadmill frame, the frame supporting a front roller and rear roller;

a flexible belt wrapped around the front roller and the rear roller;

a rigid planar treadmill deck interposed between the front and rear rollers, beneath a top portion of the belt; and a plurality of air suspension elements, each air suspension element providing a point of support for the deck, and the plurality of air suspension elements together fully suspending the deck relative to the frame.

2. The treadmill of claim 1, in which one or more of said air suspension elements comprises:

an upper fitting secured to the deck;

a lower fitting secured to the frame; and a membrane enclosing a volume of air between the upper fitting and the lower fitting.

3. The treadmill of claim 1, in which each of said plurality of air suspension elements is an air bellows having a first end mounted to the treadmill deck, and a second end mounted to the treadmill frame.

4. The treadmill of claim 2, in which one or more of said air suspension elements further comprises a dampening strap interconnecting the upper fitting and the lower fitting, the strap operating to limit movement of the upper and lower fittings away from one another during unloading of the air suspension element.

5. The treadmill of claim 3, in which the plurality of air suspension elements comprises four air bellows and the treadmill deck is rectangular, with one of said air bellows positioned near each corner of the deck.

6. The treadmill of claim 3, in which the plurality of air suspension elements comprises two air bellows positioned near a front portion of the deck, two air bellows positioned near a middle portion of the deck, and two air bellows positioned near a rear portion of the deck.

7. The treadmill of claim 2, in which one or more of said air suspension elements further comprises a damping piston attached to one of said upper or lower fittings, and a receptacle attached to the other of said upper or lower fittings, the piston configured for movement within the receptacle during loading and unloading of the air suspension element.

8. The treadmill of claim 7, in which said receptacle is enclosed and fluid-filled, the piston including a first orifice enabling bi-directional fluid flow between a first side of the piston and a second side of the piston, and check valve enabling unidirectional fluid flow from the first side of the piston to the second side of the piston.

9. The treadmill of claim 1, further comprising a belt drive motor positioned within an area defined by said flexible belt.

10. The treadmill of claim 1, further comprising an incline motor positioned within an area defined by said flexible belt.

11. The treadmill of claim 1, further comprising:

an air reservoir;

air lines interconnecting one or more of said air suspension elements with said air reservoir; and an electronically-controlled compressor operable to control air pressure within said air reservoir.

12. The treadmill of claim 11, further comprising:

an air pressure sensor providing an output indicative of measured air pressure within one or more of the air reservoir and air suspension elements; and in which said electronically-controlled compressor receives one or more control inputs, with at least one of said control inputs being determined based at least in part upon the air pressure sensor output, the compressor utilizing said control inputs to control air pressure within said air reservoir.

13. The treadmill of claim 12, in which at least one of said compressor control inputs is determined based at least in part upon belt speed.

14. The treadmill of claim 12, in which at least one of said compressor control inputs is determined based at least in part upon user impact level.

15. The treadmill of claim 12, in which at least one of said compressor control inputs is determined based at least in part upon a user-controlled configuration setting.

16. The treadmill of claim 1, further comprising a double hinge interconnecting the deck with the treadmill frame.

17. A treadmill comprising:

a rigid treadmill frame comprising a right rail and a left rail;

incline mechanism slots extending longitudinally within each of the left and right rails;

an incline crossbar extending between the left and right rails, the incline crossbar having a right end extending through the right rail incline mechanism slot and a left end extending through the left rail incline mechanism slot;

a right incline support bar having a proximal end rotatably connected with the incline crossbar right end and a distal end;

a right linkage bar having a proximal end rotatably connected with the right rail at a position forward of the right rail incline mechanism slot, and a distal end rotatably connected with the right incline support bar;

a left incline support bar having a proximal end rotatably connected with the incline crossbar left end and a distal end;

a left linkage bar having a proximal end rotatably connected with the left rail at a position forward of the left rail incline mechanism slot, and a distal end rotatably connected with the left incline support bar; and an incline motor operating to rotate a lead screw, the lead screw threaded through an incline mechanism control nut secured to the incline crossbar;

whereby operation of the incline motor can deploy and retract the left and right incline support bars to increase and decrease the angle of treadmill incline.

18. The treadmill of claim 17, in which each of the left and right incline support bars comprise a wheel rotatably mounted to the distal end thereof.

19. The treadmill of claim 17, further comprising:

decline mechanism slots extending longitudinally within each of the left and right rails;

a decline crossbar extending between the left and right rails, the decline crossbar having a right end extending through the right rail decline mechanism slot and a left end extending through the left rail decline mechanism slot;

a right decline support bar having a proximal end rotatably connected with the right rail and a distal end;

a left decline support bar having a proximal end rotatably connected with the left rail and a distal end;

a right linkage bar having a proximal end rotatably connected with the decline crossbar right end and a distal end rotatably connected with the right decline support bar between its proximal and distal ends;

a left linkage bar having a proximal end rotatably connected with the decline crossbar left end and a distal end rotatably connected with the left decline support bar between its proximal and distal ends; and a decline mechanism control nut secured to the decline crossbar, through which the incline motor lead screw is threaded;

whereby the decline support bars are deployed through rotation of the lead screw beyond a position at which the incline support bars are fully retracted.

20. The treadmill of claim 17, further comprising:

one or more upright poles connected with the rigid treadmill frame; and an electronic display mounted on said upright poles.

* * * * *